US005552811A

United States Patent [19]

Kurata et al.

[11] Patent Number: 5,552,811

[45] Date of Patent: Sep. 3, 1996

[54] LIQUID DISCHARGING APPARATUS AND PRINTING METHOD USING SUCH AN APPARATUS

[75] Inventors: Mitsuru Kurata; Hiroyuki Miyake, both of Kawasaki; Tokihide Ebata, Yokohama, all of Japan

[73] Assignee: Canon Kabushiki Kaisha, Tokyo, Japan

[21] Appl. No.: 70,691

[22] Filed: Jun. 2, 1993

[30] Foreign Application Priority Data

Jun. 26, 1992 [JP] Japan ..... 4-169408
Apr. 6, 1993 [JP] Japan ..... 5-079580

[51] Int. Cl.[6] ..... B41J 2/165

[52] U.S. Cl. ..... 347/28; 347/30; 347/31; 347/33

[58] Field of Search ..... 347/2, 3, 22, 28, 347/29, 30, 31, 33, 104, 105; 8/445, 478; 15/256.5

[56] References Cited

U.S. PATENT DOCUMENTS

| | | | |
|---|---|---|---|
| 4,296,418 | 10/1981 | Yamazaki et al. | 347/28 |
| 4,313,124 | 1/1982 | Hara | 347/57 |
| 4,345,262 | 8/1982 | Shirato et al. | 347/10 |
| 4,436,439 | 3/1984 | Koto | 347/87 X |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,723,129 | 2/1988 | Endo et al. | 347/56 |
| 4,725,849 | 2/1988 | Koike et al. | 347/105 |
| 4,739,340 | 4/1988 | Terasawa | 347/30 |
| 4,740,796 | 4/1988 | Endo et al. | 347/56 |
| 4,819,012 | 4/1989 | Kiyohara et al. | 347/30 |
| 4,908,636 | 3/1990 | Saito et al. | 347/25 |
| 5,005,024 | 4/1991 | Takahashi et al. | 347/33 |
| 5,017,946 | 5/1991 | Masuda et al. | 347/33 |
| 5,121,131 | 6/1992 | Bouldin et al. | 347/2 |
| 5,132,710 | 7/1992 | Ejiri et al. | 347/3 |
| 5,300,958 | 4/1994 | Burke et al. | 347/33 |

FOREIGN PATENT DOCUMENTS

| | | | |
|---|---|---|---|
| 0424008 | 4/1991 | European Pat. Off. . | |
| 0446885 | 9/1991 | European Pat. Off. . | |
| 0480473 | 4/1992 | European Pat. Off. . | |
| 3042988 | 7/1982 | Germany | 347/33 |
| 59-083664 | 5/1984 | Japan . | |
| 60-088744 | 6/1985 | Japan . | |
| 60-114737 | 8/1985 | Japan . | |
| 60-053492 | 3/1987 | Japan . | |
| 3-28727 | 2/1991 | Japan | 347/105 |
| 03-046589 | 7/1991 | Japan . | |

OTHER PUBLICATIONS

Quach; Ink Jet Cleaning; Xerox Disclosure Journal; Sep./Oct. 1982; 323.

Nozzle Guard and Maintance for Drop–On–Demand Printheads; IBM Technical Disclosure Bulletin; May 1985; 6965–6967.

Ondori, No. 442, Jun. 10, 1987 (Ondori–sha).

*Primary Examiner*—John E. Barlow, Jr.

*Attorney, Agent, or Firm*—Fitzpatrick, Cella, Harper & Scinto

[57] ABSTRACT

To rinse a cleaning member, a rinsing liquid is discharged from a nozzle onto the cleaning member to wipe the discharging port surface of the liquid discharging apparatus. The foregoing cleaning member is thus maintained in a rinsed condition at all times, thereby obtaining high cleaning performance of the liquid discharging port surface and long-term, stable liquid discharge from the liquid discharging head. A liquid suction force is also created in the cleaning member to draw the viscous ink from the nozzles when the liquid discharging port surface of the liquid discharging head is wiped, thereby further enhancing the cleaning performance.

44 Claims, 17 Drawing Sheets

LIQUID DISCHARGING APPARATUS AND PRINTING METHOD USING SUCH AN APPARATUS

BACKGROUND OF THE INVENTION

1. Field of the Invention

The present invention relates to a liquid discharging apparatus using a liquid discharging head to discharge ink and other liquids and a printing method using such an apparatus. More particularly, the invention relates to a printing apparatus and a printing method whereby to perform a given printing for a paper, cloth, unwoven cloth, OHP sheet, and other printing media. Furthermore, the present invention is effectively applicable to the provision of a printing apparatus capable of continuously printing a cloth having a printing width of one meter or more for a long period of time. As the specific equipment to which the present invention is applicable, there can be named various office equipment and mass-producing equipment such as printers, copying machines, facsimile apparatuses, and word processors. Further, there can be the apparatuses to drive an object by use of the liquid which is being discharged.

2. Related Background Art

As a conventional liquid discharging apparatus, there is the apparatus which performs the printing by discharging a liquid or utilizes a special liquid by discharging it. In general, the discharging portion which discharges a liquid is extremely small. Thus, the dyestuff or pigment mixed in a liquid creates a fixing state itself or foreign particles adhering to it disable the liquid to be discharged, leading to the defective printing of the printing apparatus, a problem that the discharging liquid cannot be utilized efficiently. Usually, therefore, the suction, pressurization, or the like known as recovery means is considered for use at an appropriate interval before such a problem occurs in order to cause the liquid to be forcibly exhausted, the discharging area in the discharging ports to be cleaned, or to eject air or liquid to the discharging area in the discharging ports for cleaning.

Nevertheless, while it is effective to dissolve and remove the exceedingly viscous ink or fixed substances in the discharging ports by ejecting a liquid to the discharging ports by such a recovery means as described above thereby to wash away the adhesive substances with the liquid, this method tends to create a problem that the printing density is lowered because the rinsing liquid is mixed with ink in the discharging nozzles the inside of which are negatively pressurized at that time, and causes the ink density to be reduced.

Also, with the recovery means which does not use any rinsing liquid, the exceedingly viscous ink adheres to the vicinity of the nozzles of the discharging head, thus tending to create clogging or the disabled ink discharging.

Also, in a case where the liquid is forcibly exhausted from the discharging ports by suction, there is a need for making the inner volume of the cap great in order to airtightly close the discharging head when it is sucked if the employed discharging head uses many numbers of discharging nozzles, and it becomes difficult to provide a given control in a negative pressure accordingly.

Also, for a method using only a sponge to be in contact with the discharging head for cleaning, there is a possibility that foreign particles are pressed into the nozzles to result in the disabled discharging if the employed discharging head is such as having fine nozzles of a 400-dpi resolution. Also, if this type of sponge is sufficiently wet, the liquid in the sponge is sucked into the nozzles due to the negative pressure in the nozzles to cause the ink density to be reduced, hence creating the problem that the printing density is lowered.

Further, in order to prevent the splashed mists from being accumulated on the head surface at the time of ink discharging to clog the discharging ports, it is conceivable that the head surface should be wiped off by a resilient rubber blade, but when an operation must be continued for long hours to meet an industrial requirement, there is a possibility that the wiped-off ink is accumulated without any particular place to dispose of it and becomes an exceedingly viscous ink. Thus, the discharging head is rubbed by a blade to which such an exceedingly viscous ink adheres, and in such a case, the disabled discharging is invited instead after all. Particularly, when a color printing apparatus is used, the mists are collected from its four heads, and a problem of the kind is more conspicuous.

SUMMARY OF THE INVENTION

The present invention is designed to solve the above-mentioned problems. It is an object of the invention to provide a liquid discharging apparatus and a printing method using such an apparatus capable of enhancing the cleaning effect for the liquid discharging ports of the liquid discharging head of the apparatus so that a stable liquid discharging is possible for a long time.

It is another object of the present invention to provide a liquid discharging apparatus which uses a liquid discharging head to perform the printing by discharging liquid to a printing medium, comprising a cleaning member capable of holding a rinsing liquid to clean the liquid discharging ports of the foregoing liquid discharging head; rinsing liquid supplying means to supply the rinsing liquid to the foregoing cleaning member so that it holds the rinsing liquid; rinsing liquid exhausting means to cause part of the rinsing liquid held in the foregoing cleaning member to be exhausted so that a liquid absorbing force is created in the foregoing cleaning member; and position controlling means to control the foregoing cleaning member and the liquid discharging ports of the foregoing liquid discharging head so that both of them are positioned to butt each other correlatively when the foregoing cleaning member has a liquid absorbing force in a state where the foregoing cleaning member holds the rinsing liquid.

Also, it is still another object of the present invention to provide a liquid discharging apparatus which discharges a given liquid by use of liquid discharging means, comprising wiping means to wipe the liquid discharging ports of the foregoing liquid discharging means, and rinsing means to rinse the foregoing wiping means by discharging a rinsing liquid to the foregoing wiping means.

Also, it is a further object of the present invention to provide a printing method to perform the printing by use of a liquid discharging head to perform the printing by discharging a liquid onto a printing medium, comprising a step to provide a cleaning member capable of holding a rinsing liquid to clean the liquid discharging ports of the foregoing liquid discharging head; a step to supply the rinsing liquid to the foregoing cleaning member to enable it to hold the rinsing liquid; a step to exhaust part of the rinsing liquid in the foregoing cleaning member to enable the foregoing cleaning member to create a liquid absorbing force; a step to cause the forgoing cleaning member and the liquid discharging ports of the foregoing liquid discharging head to butt each other correlatively when the liquid absorbing force is created in the foregoing cleaning member in a state where the rinsing liquid is held in the foregoing cleaning member; a step to part the foregoing cleaning member and the liquid discharging ports of the foregoing liquid discharging head correlatively; and a step to perform the printing by discharging a liquid from the foregoing liquid discharging head to the printing medium.

According to the present invention, it is possible to maintain the liquid discharging ports of the liquid discharging head always in a cleaned condition so that the liquid discharging is stabilized for a long period of time.

Hence, it becomes possible to implement a stable recovery even in a case where the liquid is highly viscous, a high density nozzle is employed, and an industrial printing is performed for a long time under severe conditions.

Also, it is possible to obtain a higher cleaning effect by adopting a flexible porous material for wiping means together with the cleaning by use of a rinsing liquid as well as the suction of the rinsing liquid. Also, it is possible to prevent the printing density from being lowered by applying the present invention to a printing apparatus because the ingression of the rinsing liquid into the nozzle unit of the head can be prevented by cleaning the head while ink or other liquids are being circulated under pressure.

As printing media, textiles, wall papers, wall clothes, paper sheets, OHP films can be named among others.

Here, in the specification hereof, the textiles include every woven cloth, unwoven cloth, and other clothes irrespective of materials, woven methods, and net methods.

Also, the above-mentioned wall papers include the adhesive materials used for covering the walls using paper, textile, synthetic resin sheet as its material.

In the specification hereof, the term "printing" is meant to include a "textile printing" and a "recording", and it does not confine the purpose of the printing in any sense. It widely includes providing printing media with images.

In the present invention, it may be possible to arrange a liquid discharging head which discharges a bleaching agent to decolor ink, for example, in addition to the liquid discharging head to discharge ink to a printing medium. This is used to locally bleach the part which is deeply dyed by ink.

Further, it may be possible to arrange a liquid discharging head to discharge an interfacial active agent for processing clothes, protecting the surface of textiles, or to discharge a coating agent to coat the surface of textiles in order to prevent ink from adhering locally thereto.

DETAILED DESCRIPTION OF THE PREFERRED EMBODIMENTS

Hereinafter, the present invention will be described in accordance with the accompanying drawings.

Figure 3:
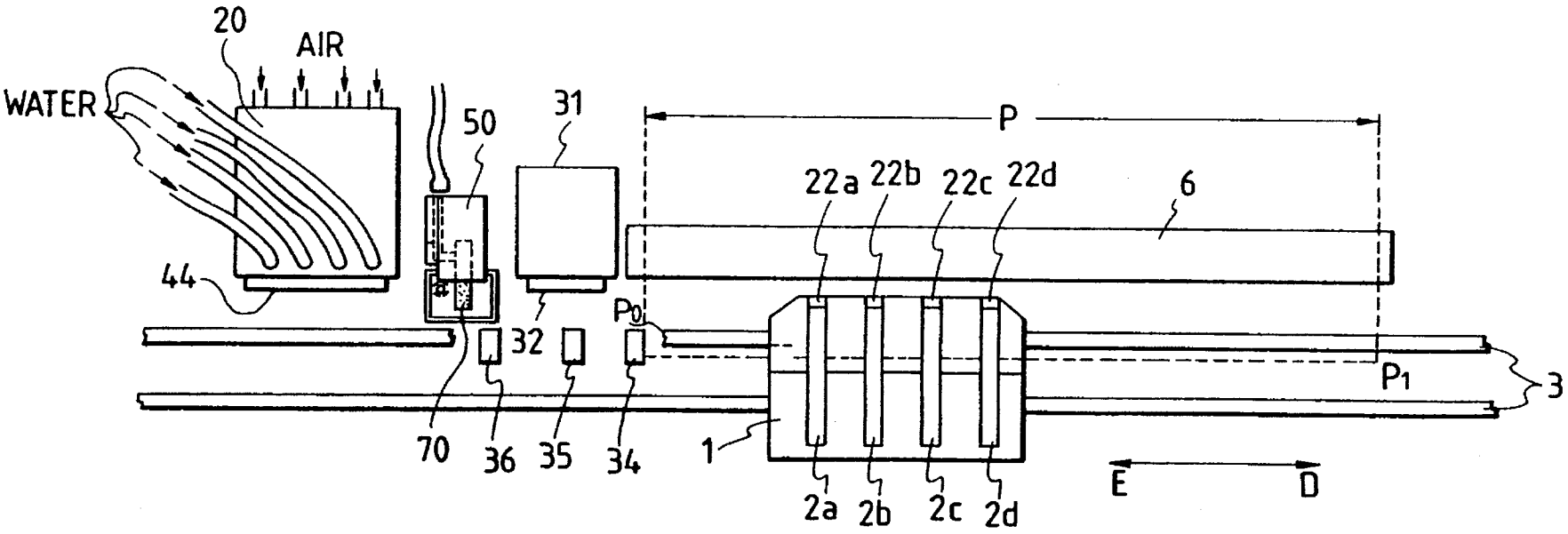
FIG. 3 is a view illustrating the operation of an ink jet printing apparatus.
Figure 9:
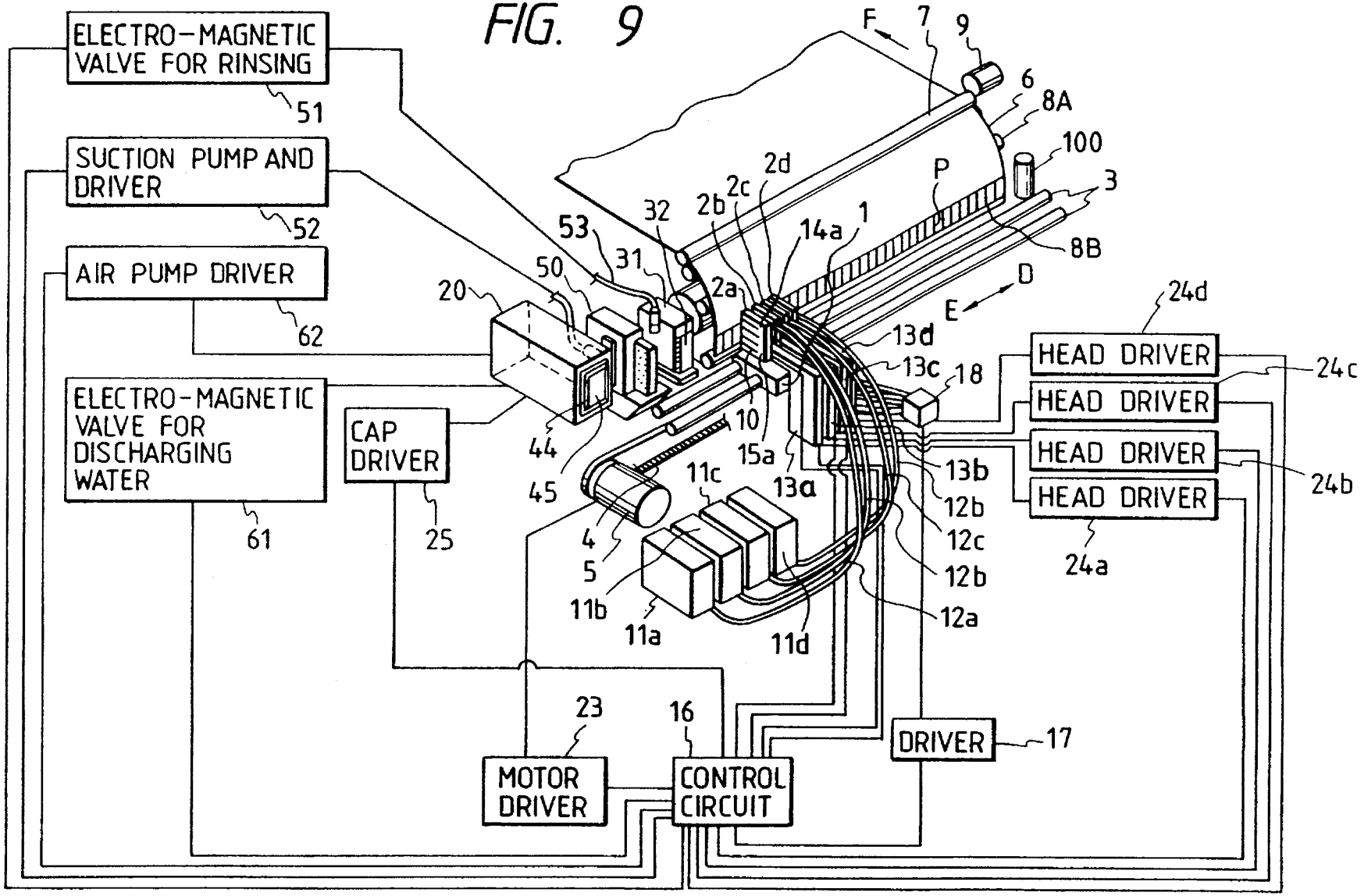
FIG. 9 is a view showing an example in a case where a liquid discharging apparatus according to the present invention is applied to a serial type ink jet printing apparatus.

FIG. 3 and FIG. 9 are views illustrating an example wherein a liquid discharging apparatus according to the present invention is applied to a serial type ink jet printing apparatus.

In FIG. 3 and FIG. 9, a carriage 1 mounts on it color printing heads 2*a*, 2*b*, 2*c*, and 2*d* respectively for four colors, cyan, magenta, yellow, and black, and a guide shaft 3 supports and guides the carriage 1 movably. Reference numerals 22*a*, 22*b*, 22*c*, and 22*d* designate the discharging surface of each printing head, respectively.

A belt 4 which is an endless belt is partially connected to the carriage 1. The carriage 1 is driven by a driving motor 5 which is a pulse motor driven by a motor driver 23. Thus, the carriage is moved on the guide shaft 3 through the belt 4 along the printing surface of a printing sheet 6. Further, there are provided a feed roller 7 to feed a printing sheet 6, guide rollers 8A and 8B to guide the printing sheet 6, and a printing sheet feed motor 9.

Also, for each of the printing heads 2*a*, 2*b*, 2*c*, and 2*d*, a liquid passage 10 is arranged to discharge ink toward the printing sheet 6. To the passage 10, ink is supplied from each of the ink tanks 11*a*, 11*b*, 11*c*, and 11*d* corresponding to each of the printing heads 2*a*, 2*b*, 2*c*, and 2*d* through each of the supply tubes 12*a*, 12*b*, 12*c*, and 12*d*. To the energy generating means (which is not shown) arranged in each of the passages 10, ink discharging signals are selectively supplied from each of the head drivers 24*a*, 24*b*, 24*c*, and 24*d* through each of the flexible cables 13*a*, 13*b*, 13*c*, and 13*d*.

Further, for each of the printing heads 2*a*, 2*b*, 2*c*, and 2*d*, head heaters 14*a*, 14*b*, 14*c*, and 14*d* (14*b*, 14*c*, and 15*d* are not shown) and temperature detecting means 15*a*, 15*b*, 15*c*, and 15*d* (15*b*, 15*c*, and 15*d* are not shown) are provided, respectively. The detected signals from the temperature detecting means 15*a*, 15*b*, 15*c*, and 15*d* are inputted into a control circuit 16 having a CPU. The control circuit 16 controls the heating in the head heaters 14*a*, 14*b*, 14*c*, and 14*d* on the basis of these signals through a driver 17 and a power source 18.

Capping means 20 are butted to the discharging port surface of each of the printing heads 2*a*, 2*b*, 2*c*, and 2*d* when the printing is at rest. The printing heads 2*a*, 2*b*, 2*c*, and 2*d* are shifted to a position opposite to the capping means 20 when the printing is at rest. Then, the capping means 20 is driven forward by means of a cap driver 25 to perform the capping by allowing a resilient member 44 to but the discharging port surface.

If the printing head is left intact in the air for a long time, the ink in the nozzles are evaporated to make it exceedingly viscous, leading to an unstable discharging. In order to prevent this, the nozzle unit is sealed from the atmosphere and airtightly enclosed (capped) when the printing is at rest. In the cap, a liquid absorbent kept sufficiently wet by ink is provided to suppress the increase of the ink viscosity as much as possible by maintaining the inside of the cap highly moisturized.

To the capping means 20, an electromagnetic valve 61 for water discharging and an air pump driver 62 are connected. The rinse water discharging nozzle and the air ejection nozzle arranged in the capping means 20 are driven under the control of a control circuit 16, respectively. Also, the ink, foreign particles, and others adhering to or fixed to the head surface are cleaned by the liquid flow and air stream ejected from each of the nozzles.

In this respect, the above-mentioned flow of the ejected liquid eases the state of the fixed particles and removes them or cause them to be in a removable condition. This is effectively applicable to the minute parts. Also, the above-mentioned ejected air stream removes from the head surface the remaining liquid itself after its ejection, thus making it possible to implement the promotion of the recovery action for the particles in the removable state as well as the liquid. From the nozzle arranged in the upper part of the flow ejection cap, the air stream is blown toward the surface of the nozzles to blow the particles and liquid down to the lower part of the printing head.

Also, when the ink is left intact for a long period of time in the head being capped, a recovery is also conducted by pressurizing the ink. In other words, if the ink is left intact for a long period of time, the ink in the nozzles is being evaporated gradually even if the head is capped and it becomes exceedingly viscous. Also, air bubbles remain in the nozzles occasionally to hinder a stabilized discharging in some cases. Therefore, when a printing is started, a pump arranged in the ink tank is driven to pressurize the ink to cause any exceedingly viscous ink and residual air bubbles in the nozzles to be exhausted outside the nozzles. This is also effective in washed away the dust particles or fluffs adhering to the nozzle surface or the dust particles which may be present in the nozzles for the maintenance of a stabilized discharging.

Clogging prevention means 31 receives the discharged ink when the printing heads 2*a*, 2*b*, 2*c*, and 2*d* perform its preliminary discharging operation. The clogging prevention means 31 is arranged to face the printing heads 2*a*, 2*b*, 2*c*, and 2*d*, and is provided with a liquid receiving member 32 as a liquid receptacle to absorb the ink which is preliminarily discharged. This means is arranged between the capping means 20 and a position to start the printing. In this respect, for the materials of the liquid receiving member 32 and a liquid holding member 45, it is effective to adopt a spongy porous material or sintered plastic among others.

Here, the preliminary discharge is an ink discharging without any particular purpose of printing itself. This discharge is conducted to assure the temperature of the area the temperature of which is lowered due to the ejected liquid flow and ejected air stream as well as to remove any unwanted particles in the discharging ports. Also, besides this, given driving pulses are provided before the printing is started to cause the ink to be discharged from the entire nozzles towards the capping unit and others (aging operation) or in some cases, this is performed while in the capping state if it is desired to enhance the wetting condition of the atmosphere surrounding the nozzles.

To the cleaning means 50, an electromagnetic valve 51 for rinsing and a suction pump driver 52 are connected, and perform under control of the control circuit 16 the discharge of rinsing liquid from rinsing means 53, and the suction of rinsing liquid form the cleaning means 50, respectively. As the rinsing liquid, water is used, for example.

Figure 10:
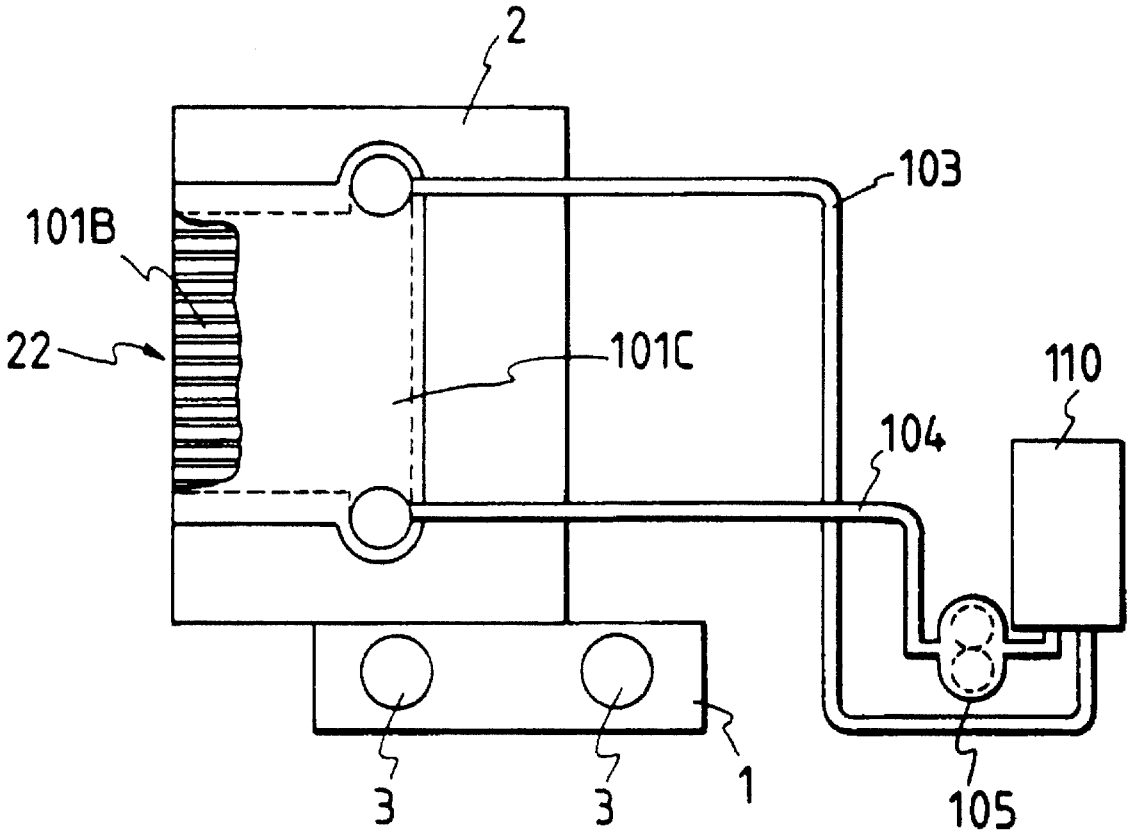
FIG. 10 is a view showing the structural example of a liquid discharging head.

FIG. 10 shows the structural example of a liquid discharging head. A reference numeral 2 designates a discharging head; 22, its discharging port surface; 101B, the nozzle unit in which a plurality of liquid passages are arranged in parallel in the vertical direction, and the discharging energy generating elements such as electrothermal transducers are provided; and 101C, an ink chamber to share the ink supply to each of the liquid passages, which connects them with an ink tank 110 through supply tubes 103 and 104. Then, for one supply tube 104, a gear pump 105 is provided to pressurize the ink in the ink supply system to the printing head 2 and cause the ink to be exhausted from the discharging ports when the air bubbles and particles mixed in the supply passages or in the nozzle unit 101B are removed or a discharge recovery process such as the removal of the exceedingly viscous ink, and the like is performed.

Figure 1:
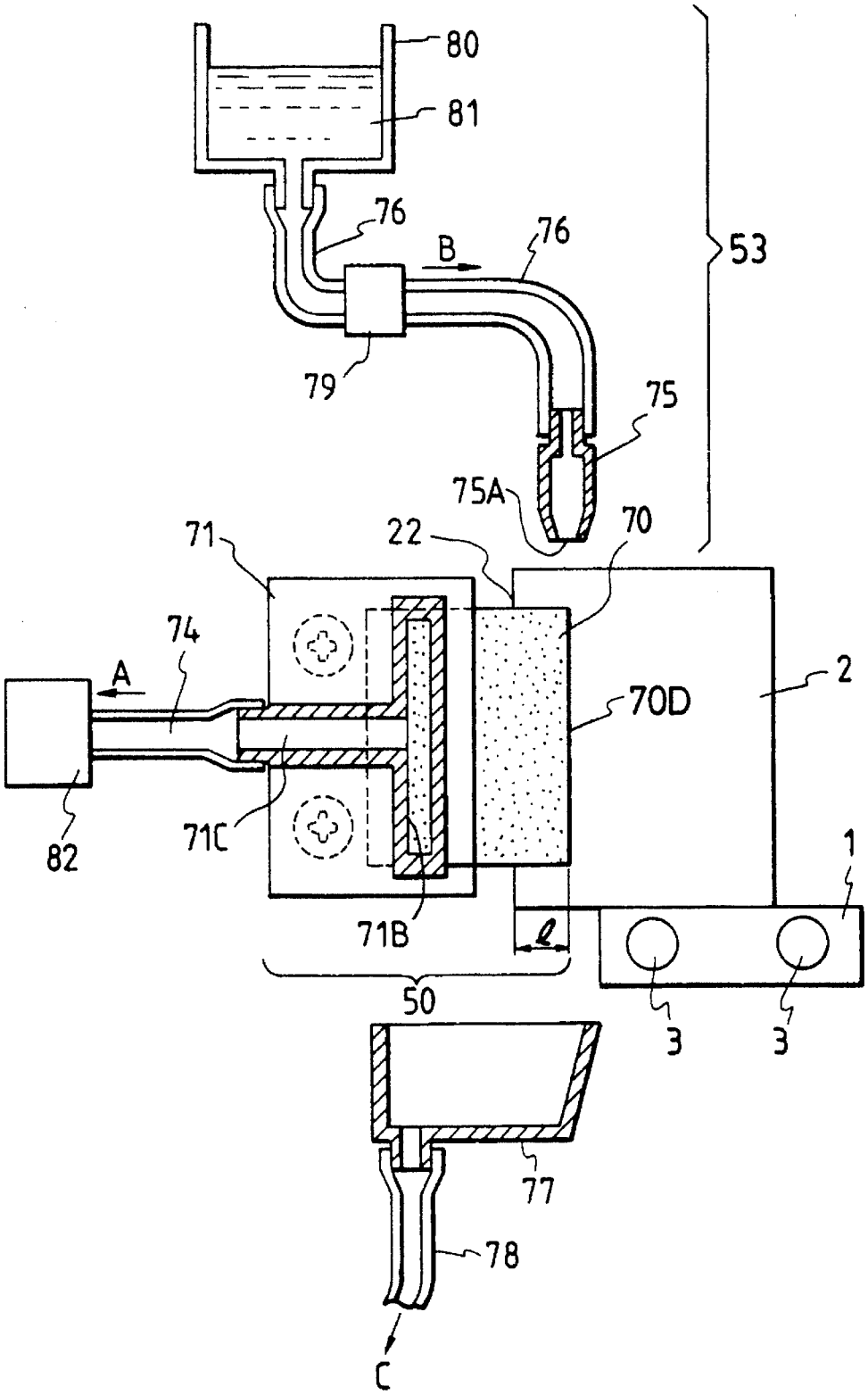
FIG. 1 is a view illustrating cleaning means observed in the main scanning direction of a head.
Figure 2:
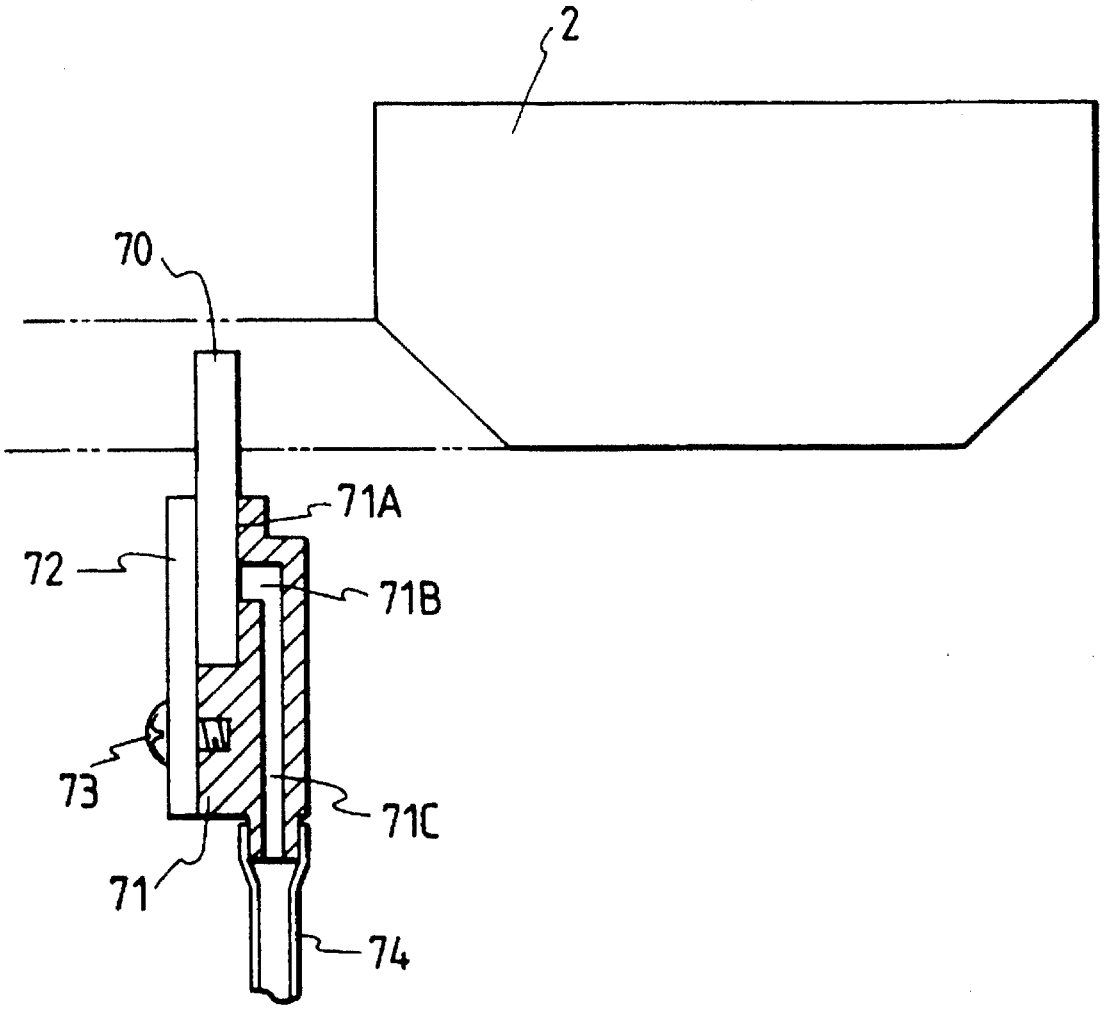
FIG. 2 is a view illustrating a cleaning member and a head observed from above.

FIG. 1 and FIG. 2 show the structural example of the cleaning means 50. FIG. 1 is a view illustrating the cleaning means 50 observed in the main scanning direction of the head 2. FIG. 2 is a view illustrating a cleaning member 70 and a head 2 observed from above. The cleaning member 70 is a flexible body having a three dimensional net structure, for example, is made of a continuously porous material. As the material for the cleaning member, a high molecular porous material is preferably usable. When a high molecular porous material is used, it is preferable to use the one which does not change its volume even when it absorbs ink but not the one which changes its volume remarkably by absorbing ink mists such as a high molecular foaming material. As a suitable one, a material of a foaming formal resin type is preferably named. Also, it may be possible to use materials having the three dimensional net structure other than the porous materials described above.

Also, as a cleaning member used here, it is possible to utilize a high molecular porous material of a sintered type. For example, it is possible to name a low density polyethylene, high density polyethylene, high molecular polyethylene, compound polyethylene, polypropylene, polymethyl methacrylilate, polystyrene, acrylonitrile copolymer, ethylene-vinyl acetate copolymer, flouric resin, phenol resin, and other thermally sintered materials. Particularly in consideration of the ink mist absorptivity and ink resistivity, it is preferable to employ those using a low density polyethylene, high density polyethylene, high molecular polyethylene, or polypropylene.

Particularly, a continuously pored ultrafine material using urethane as its material (Commercial name: RUBY-CELLCLEAN—Toyo Hygienic Material, Inc.) is suitably used among them.

Now, a reference numeral 71 designates a holder to pinch and fix the cleaning member 70 between the fixing boards 72, and 73, fixing screws. For the holder 71, an opening 71B is arranged on the surface 71A which butts the cleaning member 71, and is connected to a suction tube 74 through a conductive passage 71C. Thus, the structure is arranged to exhaust the rinsing liquid and ink contained in the cleaning member 70 by the sucking means 82 comprising a pump in the direction indicated by an arrow A. For this sucking means 82, it may be possible to adopt an exhausting means which is arranged in such a manner that a porous material or a fabric material is connected to the cleaning member 70 to form a passage for the disposal of the rinsing liquid exhausted from the cleaning member.

After the rinsing by means of this suction of the rinsing liquid, the suction capability of the cleaning member 70 against the ink and foreign particles is restored due to the appropriately reduced amount of the rinsing liquid, hence making it possible to enhance the cleaning effect for the discharging surface 22 of the head 2. Also, the leading edge 70D of the cleaning member 70 is overlapped with the discharging surface 22 of the discharging head 2 by a length indicated by l. Therefore, when the head 2 is in a scanning operation, the discharging surface 22 of the head 2 is wiped by this overlapping portion thus arranged.

A reference numeral 75 designates a nozzle to supply the rinsing liquid. The rinsing liquid 81 is supplied in the direction indicated by an arrow B from a tank 80 serving as a rinsing liquid supply means through a rinsing liquid supply tube 76 as an electromagnetic valve 79 opens or is closed, and further supplied downward to the cleaning member 70 from the discharging port 75A of the nozzle. In this way, the cleaning arrangement is made.

A reference numeral 77 designates a receptacle container arranged below the cleaning member 70 to receive the droplets of the rinsing liquid which are not absorbed by the cleaning member 70 when the rinsing liquid is discharged from the supply nozzle 75, and the ink and foreign particles adhering to the cleaning member 70 which also drop together with the droplets of the rinsing liquid; and 78, an exhaust tube to exhaust the rinsing liquid received by the receptacle container 77 to an exhaust unit (not shown) in the direction indicated by an arrow C.

Now, hereinafter, the description will be made of the operation of an ink jet printing apparatus. In FIG. 3, a printing start detecting sensor 34 and a capping means detecting sensor 36 detect respectively that each of the printing heads 2*a*, 2*b*, 2*c*, and 2*d* is in a given capping position. A preliminary discharge position sensor 35 detects the fiducial position for the preliminary discharging operation to be performed by the printing heads 2*a*, 2*b*, 2*c*, and 2*d* while being shifted in the scanning direction.

Figure 4:
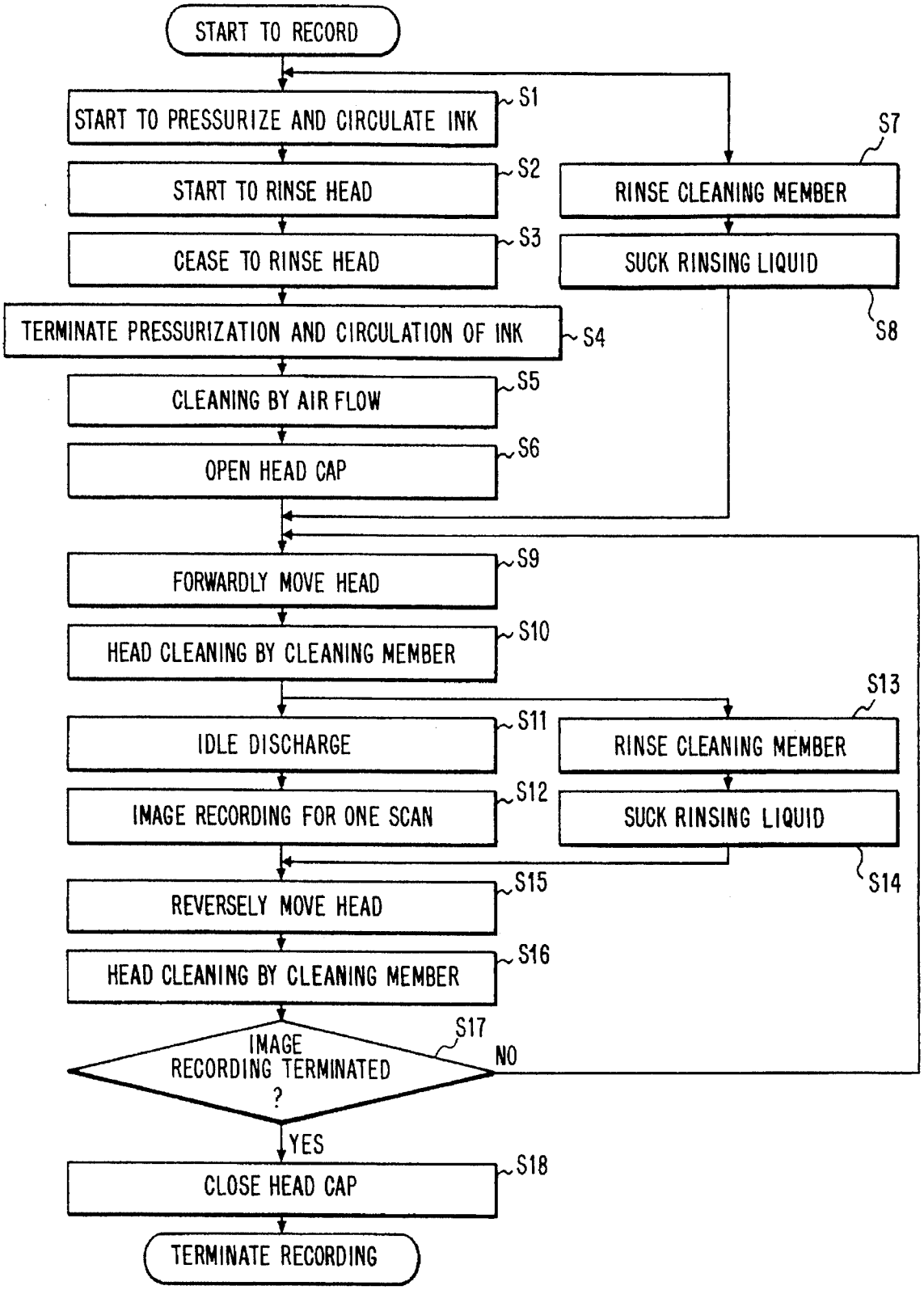
FIG. 4 is a flowchart showing the operational sequence in the present embodiment.

FIG. 4 is a flowchart showing the operational sequence in the present embodiment. At first, while in a standby state, each of the discharging port surfaces 22*a*, 22*b*, 22*c*, and 22*d* of the printing heads 2*a*, 2*b*, 2*c*, and 2*d* is capped by the capping means 20. When a printing signal is inputted into the control circuit 16, a pressurized ink circulation is started (step S1). In order to enhance the recovery effect by the pressurized ink circulation, the head cleaning is executed simultaneously (step S2). In step S3 and step S4, when the head cleaning and the pressurized ink circulation are terminated, the residual liquid droplets and others on the discharging surface of the discharging head are removed (step S5) by the application of the air stream cleaning. Then, the head cap is released (step S6).

Together with the recovery by means of the pressurized ink circulation, the cleaning member 70 is cleaned (step S7). By this cleaning, the exceedingly viscous ink, foreign particles, and others adhering to the cleaning member 70 are washed away together with the rinsing liquid. Also, part of the ink is in a condition that it flows out from the discharging surface of the nozzles by the pressurized ink circulation. Therefore, it is possible to prevent the rinsing liquid from flowing into the liquid chamber side in the head from the nozzle discharging surface. Thus, there is no resultant reduction of the ink density in the liquid chamber due to the mixture of the rinsing liquid when a printing is executed after the head cleaning; hence preventing disadvantages such as a lowered printing density.

Then, in the next step S8, the rinsing liquid is sucked so that the residual rinsing liquid in the cleaning member 70 is appropriately reduced, and its capability to collect ink, foreign particles, and others is enhanced thereby to increase the cleaning efficiency of the cleaning member 70. Also, the rinsing liquid being sucked and exhausted, there occurs due to the capillary phenomenon the liquid absorbing force in the porous material serving as the cleaning member 70. By making this liquid absorbing force greater than the negative pressure (meniscus formation force) given to the nozzles of the liquid discharging head, together with the synergistic effects obtainable form the high affinity of the residual rinsing liquid such as water in the cleaning member 70 and the ink in the nozzles, the ink can be in a state where it is drawn from the nozzles when the cleaning is executed. As a result, the mixture of the rinsing liquid in the liquid chamber can be prevented, hence making the prevention of the lowered ink density possible. Further, the ink absorbing capability in the nozzles also occurs. It is also possible to produce another effect that the exceedingly viscous ink in the nozzles can be removed simultaneously.

As described above, the rinsing liquid is sucked in the step S8, and an appropriate amount of the remaining rinsing liquid in the cleaning member 70 is reduced. According to an experiment, when a water is contained in a cleaning member (a continuously porous material having a vacancy ratio of 70 to 85%: Commercial name: RUBY-CELLCLEAN—Toyo Hygienic Material, Inc.) substantially in the same volume as this material before suction, and an approximately 50% of the foregoing volume of water is absorbed and exhausted from the cleaning material, for example, it is found that the water which contacts this cleaning member after that is again absorbed in 30 seconds up to an approximately 80% of the volume of the water which has been exhausted.

As the cleaning member, it is preferable to use a three dimensional net material or a continuously porous material. In a case where a rinsing liquid is contained substantially in the same volume as that of the cleaning member at the outset, it is possible to create a high liquid absorptivity in the cleaning member by causing it to exhaust the rinsing liquid by suction preferably in a 30% or more of such a volume, more preferably in a 40% or more, or most preferably in 50% or more.

Figure 5:
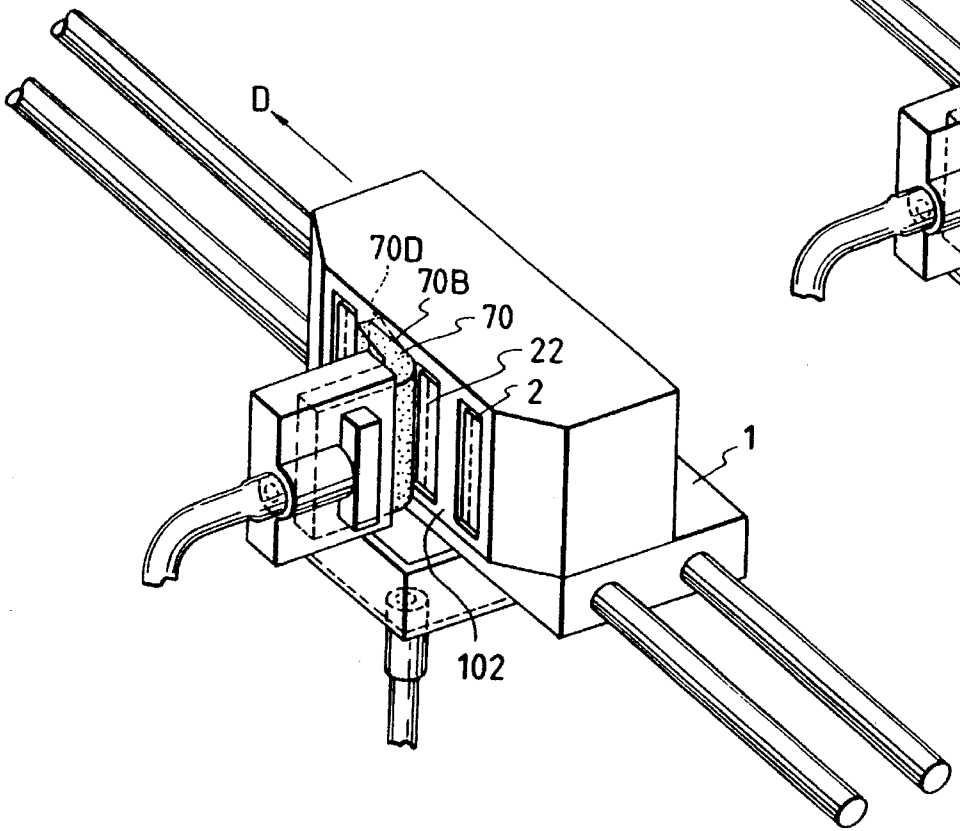
FIG. 5 is a perspective view showing the relation between a cleaning member and a head.

Now, subsequently, a driving signal is emitted from the motor driver 23 to transfer the driving force of the driving motor 5 to the carriage 1 through the belt 4. Thus, the carriage 1 is driven to allow the head to reciprocate (step S9). Then, as shown in FIG. 5, when the carriage 1 passes the cleaning means 50, the cleaning member 70 wipes the discharging port surface 22 sequentially to clean it (step S10). In this respect, according to the present embodiment, the cleaning means to wipe off the rinsing liquid, ink, foreign particles, and others on the discharging port surface and clean it. As shown in FIG. 5, when the discharging port surface is wiped off by the cleaning member 70, the cleaning member being flexible is held down in the same direction as the shifting direction D of the carriage 1 to cause the wiping surface 70B to wipe off the discharging port surface 22 with its weak resiliency, thus executing the cleaning. Therefore, even if there are steps between the holder surface 102 and the discharging port surface 22, the cleaning effects are not affected.

Particularly, since the edge 70D of the cleaning member 70 is allowed to reach the recess of the holder, it is possible to clean the stepping parts between the holder surface 102 and the discharging port surface Then, each position of the printing heads 2*a*, 2*b*, 2*c*, and 2*d* is detected by the preliminary discharge position detecting sensor 35 to enable the clog prevention means 31 to discharge ink preliminarily for a given period of time (step S11). The ink droplets are being discharged for the image printing in a dot matrix pattern in the printing width portion P of a printing sheet 6, beginning at the printing start detecting position $P_0$ detected by the printing start detecting sensor 34 while this means is in travel in the direction indicated by an arrow D (step S12).

At the same time, as in the foregoing step S7, the cleaning of the cleaning member is performed (step S13), and then, as in the foregoing step S8, the suction of the rinsing liquid is performed (step S14) to recover the cleaning capability of the cleaning member. Subsequently, the carriage 1 is driven in the direction indicated by an arrow E to return to the empty discharging position. At the same time, the printing sheet 6 is fed by the printing width P in the direction indicated by an arrow F.

Then, the carriage 1 is further returned to the capping position (step S15). At this Juncture, the carriage 1 passes the cleaning means 50 so that the discharging port surface 22 is cleaned by the cleaning member 70 (step S16).

Figure 6:
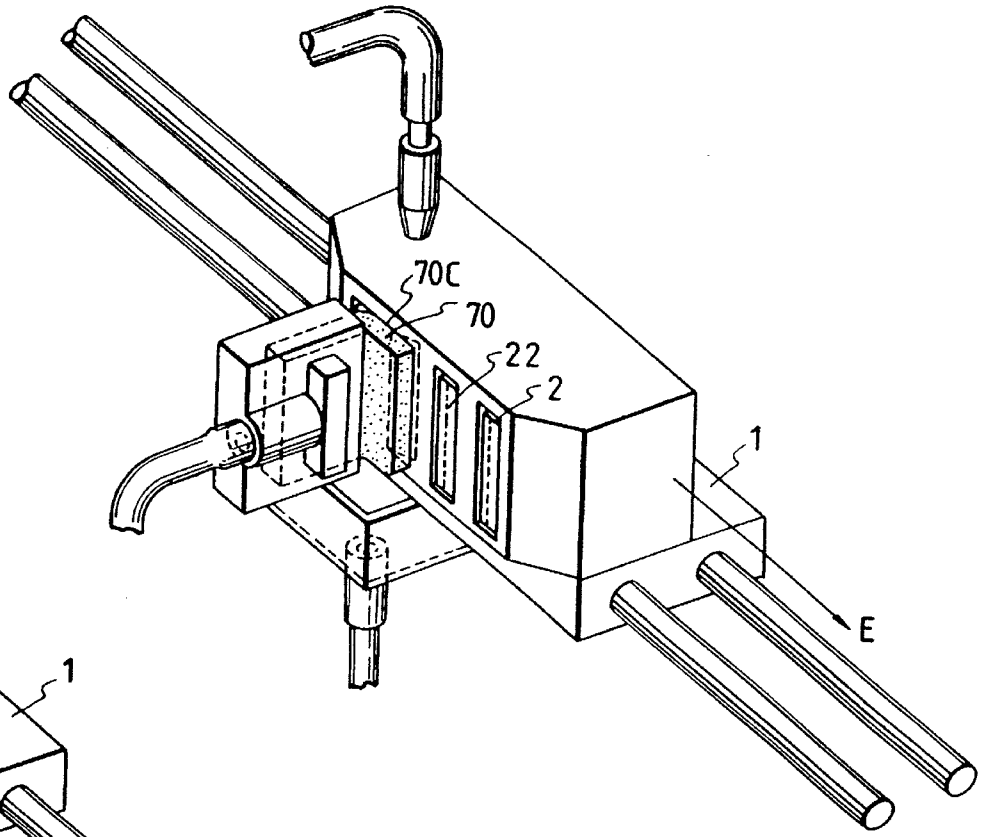
FIG. 6 is a perspective view showing the relation between a cleaning member and a head.

As shown in FIG. 6, the cleaning member 70 is held down in the carriage traveling direction E as in the case of the forward movement. Thus, the discharging port surface 22 is wiped off by the wiping surface 70C for cleaning.

Then, if the image printing is continued (NO in step S17), the process will return to the step S9 to allow the carriage 1 to conduct its returning movement, and as shown in FIG. 5, the cleaning in the returning movement is performed (step S10). At this juncture, since the wiping surface 70B of the cleaning member is used in the forward movement, the wiping surface 70C which is once stained is not used to wipe off the discharging port surface 22. Thus, the cleaning effect is not only affected, but it is doubly enhanced.

On the other hand, if the image printing is terminated (YES in step S17), the discharging surface 22 of the head 2 is capped by the capping means 20 and closed airtightly (step S18).

Figure 7:
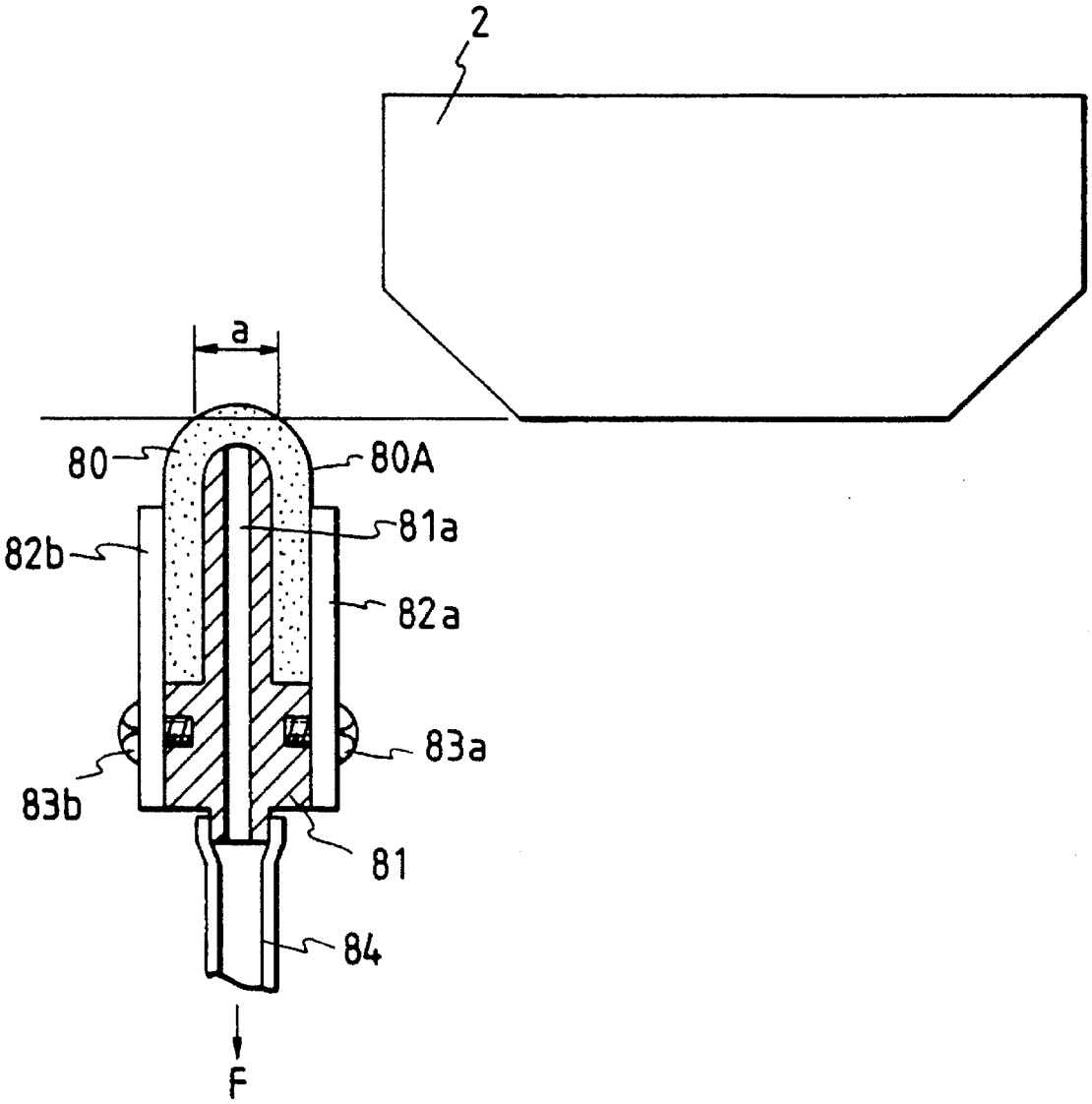
FIG. 7 is a view showing another example of the cleaning member.

FIG. 7 is a view illustrating another embodiment. A reference numeral 80 designates a cleaning member which is held to a holder 81 by the fixing boards 82*a* and 82*b* which pinch the both ends of the cleaning member; and 83*a* and 83*b*, mounting screws. An opening 81*a* is provided for the holder 81. Thus, the arrangement is made so that the rinsing liquid contained in the cleaning member enables the ink to be exhausted together in the direction indicated by an arrow F by a suction means (not shown) through a suction tube 84.

As shown in FIG. 7, a flexible and resilient material can be used for the cleaning member 80. Therefore, it is possible to widen the wiping area a with respect to the head 2 by making the surface of the wiping portion 80A round.

Figure 8:
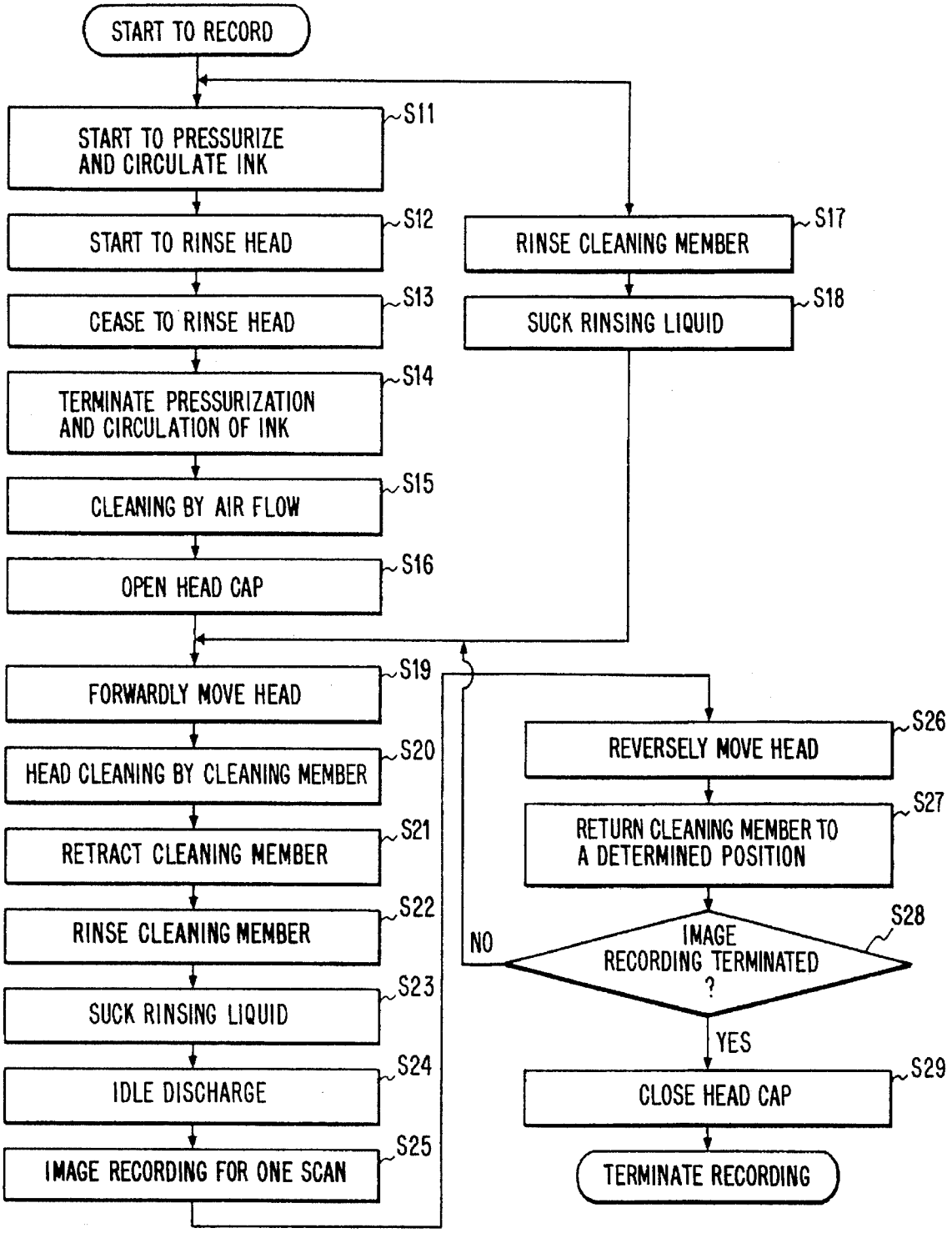
FIG. 8 is a flowchart showing another example of the operational sequence in the present embodiment.

Also, if the cleaning by the cleaning means 50 is good enough just by the forward movement alone, it may be possible to perform the head cleaning by the cleaning member in the forward movement of the head (step S19) as indicated by a flowchart shown in FIG. 8, and then (in step S20), the cleaning member is retracted (in step S21); thus omitting any cleaning in the returning movement of the head. In this way, the printing speed can be increased as a whole.

In this respect, if the cleaning by the cleaning means 50 is good enough just by the returning movement of the head, the cleaning in its forward movement can be omitted likewise; hence making it possible to increase the printing speed as a whole.

Figure 11:
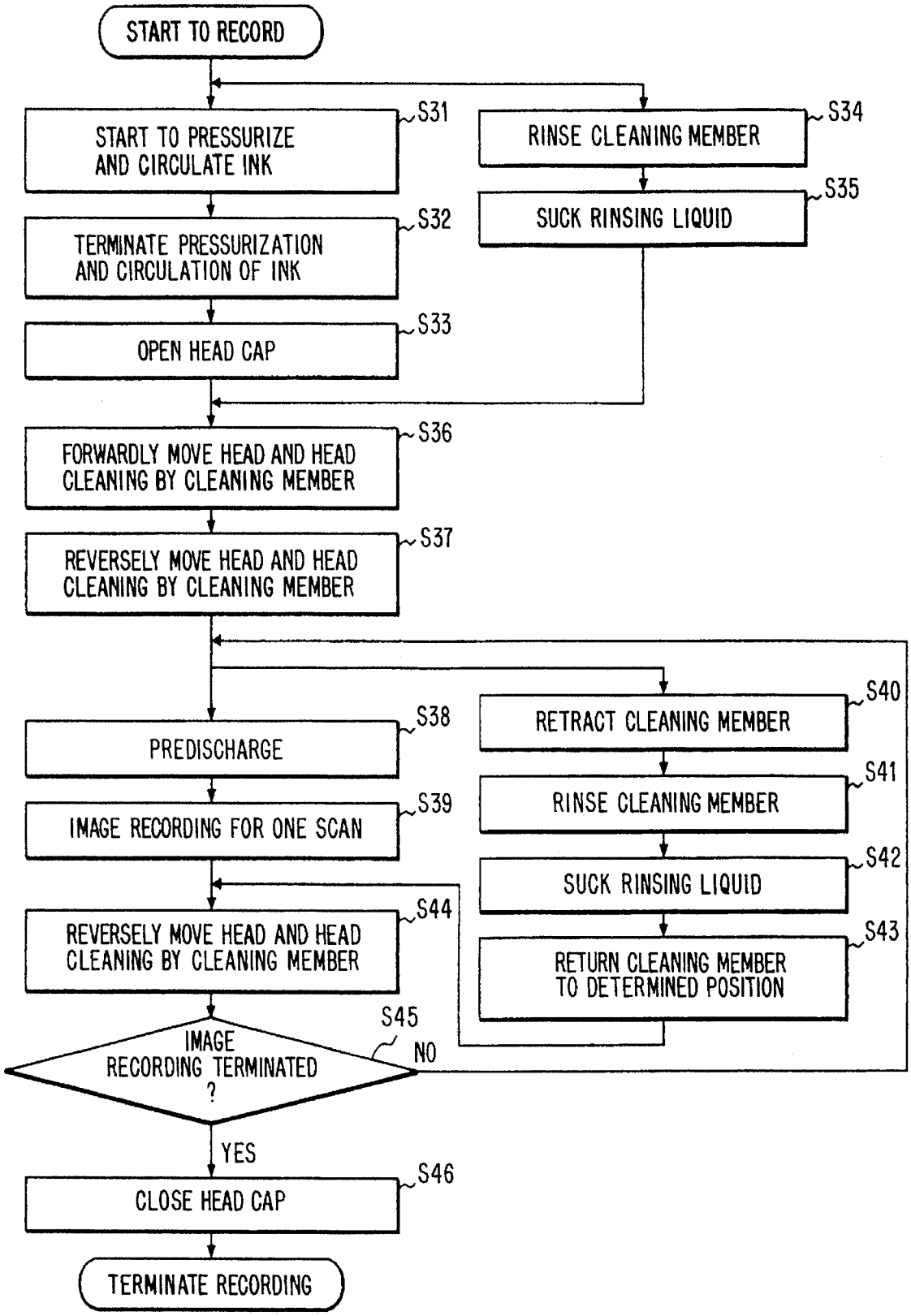
FIG. 11 is a flowchart showing another example of the operational sequence in the present embodiment.

FIG. 11 is a flowchart showing another operational sequence according to the present invention. In this example, the head cleaning process in the steps S3, S4, and S6 in the flowchart shown in FIG. 4 is omitted. Instead, as represented in steps S36 and S37 shown in FIG. 11, the advancing and returning movements of the head are conducted before the image printing, and the head cleaning is executed by the cleaning member at each time.

Now, since the head surface is more stained (more residual ink) by the pressurized ink circulation than at the time of image printing, it is arranged in the present embodiment to wipe it once each in the advancing movement and in the returning movement. In this way, the water rinsing and air cleaning for the head are omitted. On the other hand, in printing, only the wiping operation in the head returning movement is performed. This is because when the wiping operation in the head advancing movement is completed after the termination of the one scan in the main scanning direction, the carriage reaches the starting position to initiate the main scanning; thus making it possible to speed up the printing operation as a whole, leading to a shorter printing time.

Also, in the present embodiment, while a flexible porous material is used for the cleaning member, it may be possible to enhance further the cleaning effect using the conventional wiping, where a conventional rubber blade is employed as its cleaning member, by combining the rinsing means using the present cleaning member. Furthermore, in the present embodiment, while a structure is disclosed where the discharging port surface of the head is cleaned by the cleaning member subsequent to the suction of the rinsing liquid of the cleaning member, it may be possible to conduct the cleaning of the head discharging port surface and the suction operation at the same time. In this way, the suction force of a pump and others is directly exerted on the discharging port surface of the printing head to enhance the resultant liquid absorptivity of the cleaning member. Therefore, this is particularly effective when the residual droplets of ink and rinsing liquid adhering to the cleaning member due to cleaning are great.

Also, in the present embodiment, while the description has been made of an example wherein the suction of the rinsing liquid of the cleaning member is performed by operating a suction pump, the present invention is not limited thereto. For example, it may be possible to cause part of the rinsing liquid to be exhausted from the cleaning member by pressing the cleaning member forcibly whereby to squeeze the rinsing liquid or by a similar method.

Also, in the present embodiment, the description has been made of an example wherein the liquid discharging ports of the liquid discharging head are wiped off by the cleaning member while the liquid discharging head is being shifted in the main scanning direction, the present invention is not limited thereto. It may be possible to make an arrangement so that a cleaning member having a liquid absorptivity in the state where it holds the rinsing liquid is caused to advance toward the liquid discharging head to butt it to the liquid discharging ports of the liquid discharging head, and then part it therefrom to clean the liquid discharging ports.

Figure 12:
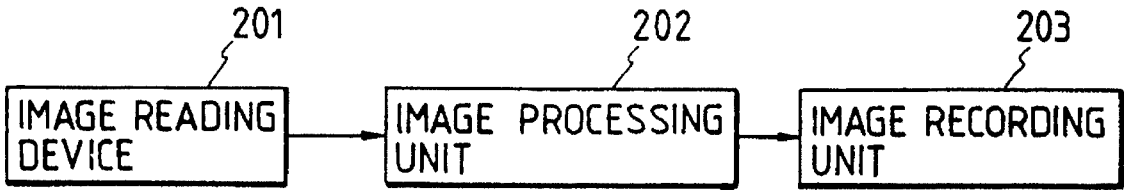
FIG. 12 is a view showing the fundamental structure of an ink jet printing system from a step to read images and to a step to print them.

FIG. 12 is a block diagram showing the fundamental structure of a ink Jet printing system. This ink Jet printing system comprises widely an image reading device 201 which reads an original image produced by a designer or the like and converts the original image into the original image data represented by electrical signals; an image processing unit 202 which fetches the original image data from the image reading device 201 to process and output them as the image data; and an image printing unit 203 which performs the printing on a textile and other printing media in accordance with the image data produced by the image processing unit 202. In the image reading device 201, an original image is read by a CCD image sensor. In the image processing unit 202, the data are produced from the inputted original image data to drive the ink jet printing unit A-2 (FIG. 13) which discharges the four color ink materials, magenta (mark M), cyan (mark C), yellow (mark Y) and black (mark Bk) which will be described later. In producing the data, an image processing where the original image is reproduced by dot arrangements, the color distribution to determine the color tone, and the process and selection of the pattern sizes such as the modification of layout, enlargement, and reduction. In the image printing unit 203, the printing is performed by the ink jet printing unit A-2. The ink jet printing unit A-2 performs the printing by flying fine ink droplets toward the printing medium and causes the ink droplets to adhere to the printing medium.

Figure 13:
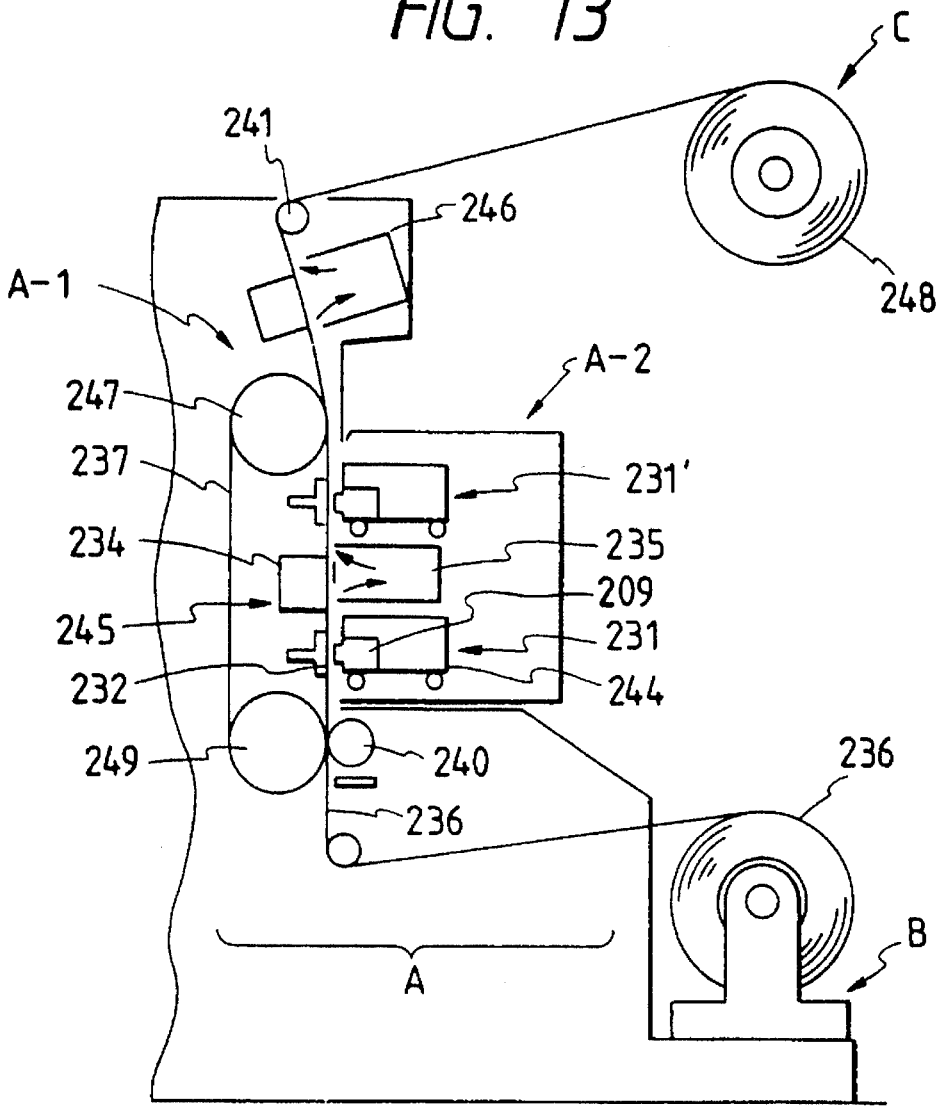
FIG. 13 is a cross-sectional view showing the structure of an image printing unit.

FIG. 13 is a view schematically showing the outline of an image printing unit particularly suitable for a liquid discharging apparatus according to the present invention. Here, in the description set forth below, only the image printing unit will be described, and any description of the cleaning of the liquid discharging ports of the liquid discharging head will be omitted. However, it should be good enough if only the same cleaning mechanism as described in the foregoing embodiment is provided for the image printing unit which will be described below. A printing apparatus shown in FIG. 13 comprises widely a cloth supply unit B which supplies a printing medium such as a rolled textile for which a preparatory process for textile printing is provided, a main unit A which precisely line feeds the textile being supplied for the printing by an ink Jet head, and a winding unit C which dries the printed textile and winds it up. Then, the main unit A further comprises a feeding unit A-1 to precisely feed the textile including a platen, and an ink jet printing unit A-2.

Hereinafter, the description will be made of the operation of this apparatus by exemplifying a case where a textile printing is performed using a preparatorily processed textile.

A rolled textile 236 which is preparatorily processed is being fed by the supply unit B to the main unit. In the main unit, a thin endless belt 237 which is precisely step driven is tensioned around a driving roller 247 and a winding roller 249. The driving roller 247 is directly step driven by a high resolution stepping motor (not shown) to step feed the belt by that stepping amount. The cloth 236 thus fed is pressed and tensioned by a pressing roller 240 onto the surface of the belt 237 which is backed up by the winding roller 249.

The cloth 236 thus step fed by the belt is positioned in a fixed position by a platen 232 arranged on the back side of the belt in a first printing unit 231 and is printed by the ink let head 209 from its surface side. Each time one line printing is completed, it is step fed by a given amount, and subsequently, heated by a heating plate 234 from the back side of the belt and is dried from the surface by a hot air which is supplied from and exhausted to a hot air duct 235. Then, continuously, in a second printing unit 231', a superposed printing is performed in the same manner as in the first printing unit. In this respect, the drying section may be a given space for drying ink naturally instead of any forced drafting means while the printing medium is being transferred from the first ink Jet printing unit to the second ink jet printing unit.

The printed textile is torn and again dried in a rear drying unit 246 arranged in the same manner as in the foregoing hot plate and hot air duct. Thus, the printed textile is guided to a guide roller 241 and wound by a winding roller 248. Then, the rolled textile is removed from the apparatus and finished to a final product in a batch process through an additional process including coloring, rinsing, and drying.

Now, in accordance with FIG. 14, the details in the vicinity of an ink Jet printing unit A-2 will be described.

Here, the preferred embodiment is such that information is printed by the head of the first printing unit after thinning the dot numbers, and that after the drying process, the ink droplets are discharged by the head of the second printing unit to complement the information which has been thinned in the first printing unit.

Figure 14:
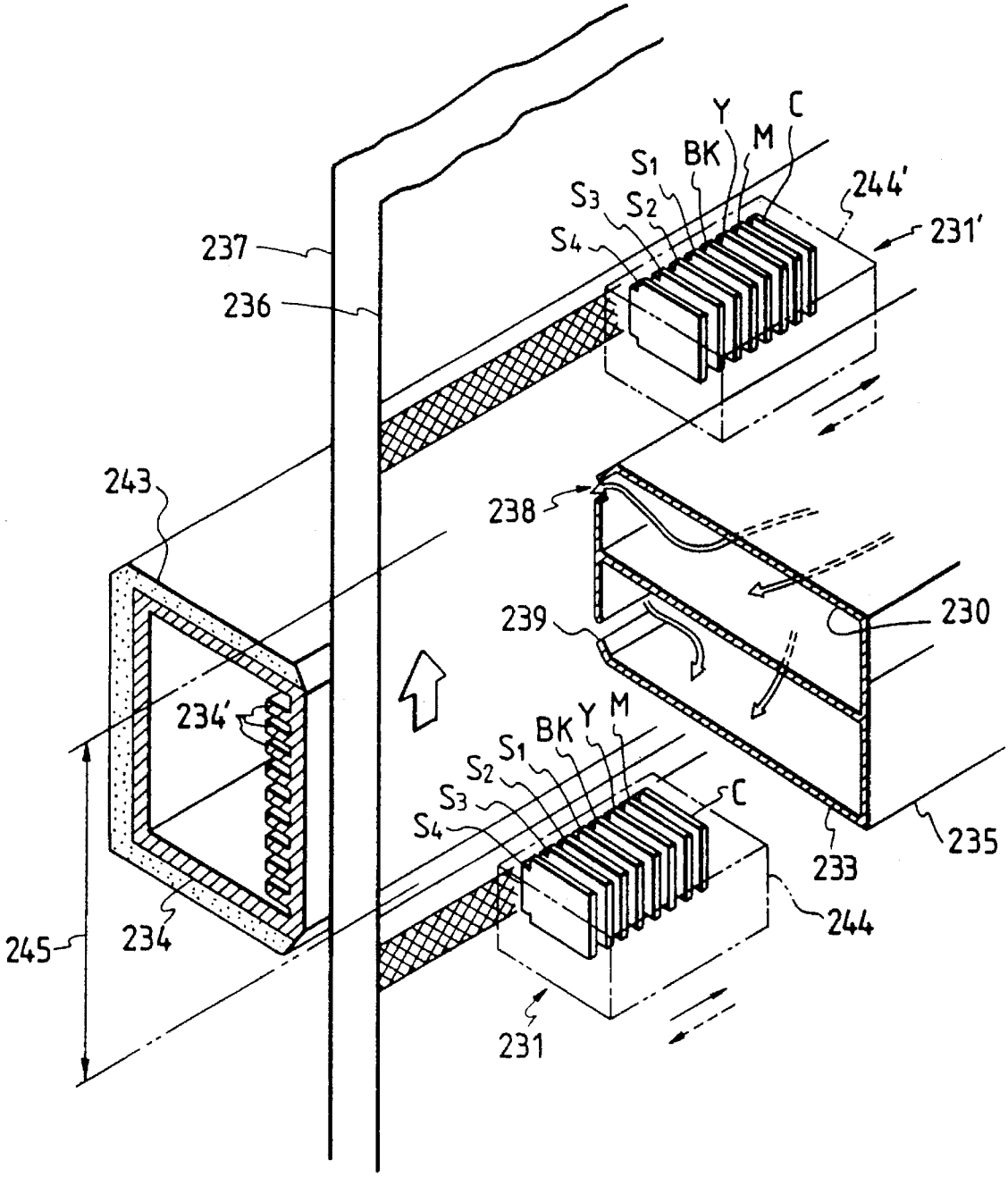
FIG. 14 is a perspective view showing the structure of an image printing unit.

In FIG. 14, the textile 236 which a printing medium is tensioned on the belt and step fed upward in FIG. 14. In the first printing unit 231 shown in the lower part of FIG. 14, there is a first carriage 244 having eight ink jet heads for special colors S1 to S4 in addition to the Y, M, C, and Bk. The ink jet heads (printing heads) according to the present embodiment use those having the elements which generate thermal energy to give the film boiling to ink as the energy utilized for discharging the ink, and also having 128 discharging ports arranged in a density of 400 dpi (dots/inch).

On the downstream side of the first printing unit, there is provided a drying unit 245 comprising a hot plate 234 which gives heat from the back side of the belt and a hot air duct 235 which give a hot air from the surface for drying. The heat transmission surface of the hot plate 234 is pressed onto a strongly tensioned endless belt 237 to heat this conveyer belt 237 from its back side intensively with a high temperature high-pressure steam which is provided in a hollow inner side. The conveyer belt 237 directly heats the textile 236 tensioned on it effectively by the thermal conduction. In side the hot plate, heat collecting fins 234' are arranged to concentrate heat onto the back side of the belt efficiently. The side which is not in contact with the belt is covered with a heat isolation material 243 to prevent any heat loss.

On the surface side, a dry hot air is blown from a supply duct 230 arranged on the downstream for the enhancement of the drying effect obtainable by blowing an air having a lower moisture onto the drying textile. Then, the air streaming in the direction opposite to the conveying direction of the textile while containing a sufficient moisture is sucked by a suction duct 233 arranged on the upstream side by a force which enables the air to be sucked in a quantity much greater than that of the blowing. In this way, a caution is taken so as not to give any dew drops to the surrounding equipment due to the leakage of evaporated moisture. The supply source of the hot air is arranged in the back side in FIG. 14, and the suction is conducted from the front side. The pressure difference between the blowing outlet 238 and suction inlet 239 facing the textile is arranged to be even over the entire area in the longitudinal direction. The air blowing and sucking sections are offset toward the downstream side with respect to the center line of the hot plate arranged on the back side so that the air can be blown onto the place which is sufficiently heated. In this way, it is possible for the first printing unit 231 to intensively dry a good amount of water contained in the ink including a thinning agent, which the textile has received in the first printing.

In the downstream thereof (upward), the second printing unit 231' is arranged. The second printing unit comprises a second carriage 244' having the same structure as the first carriage.

Then, the superposed printing is performed using the first printing unit 231 and the second printing unit 231'. Here, the description will be made of the superposed printing in detail.

Figure 15:
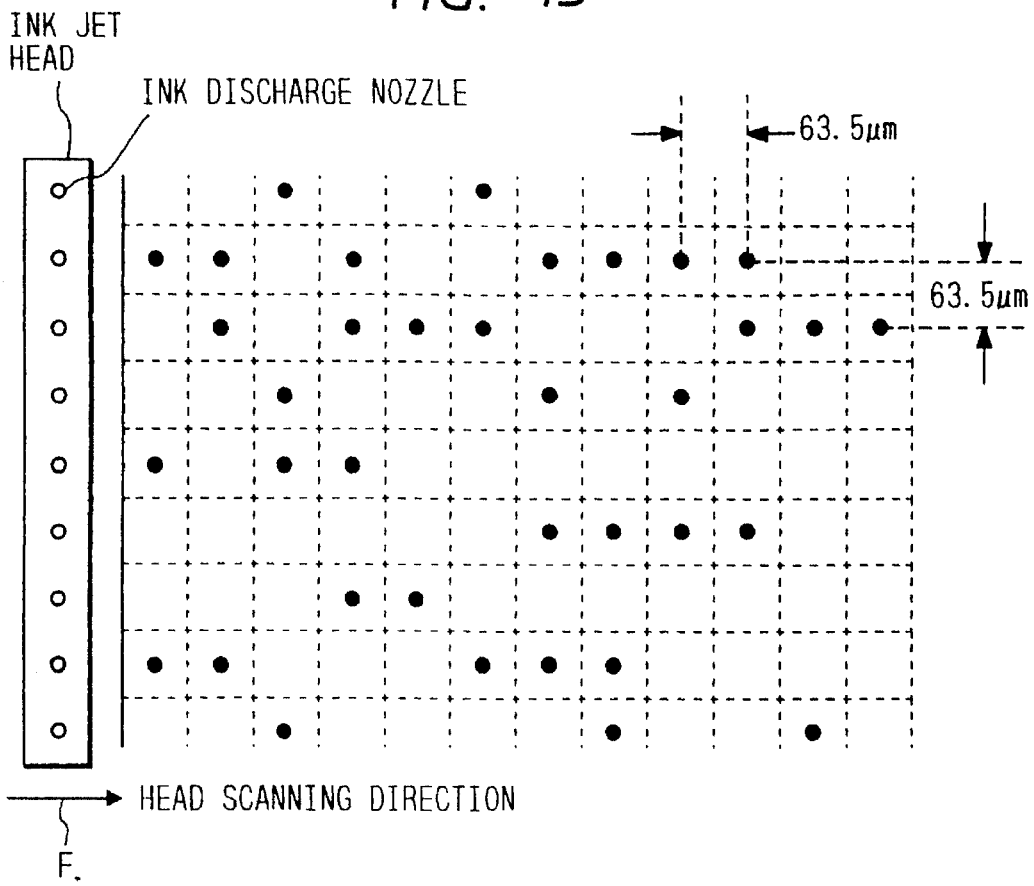
FIG. 15 is a view illustrating a printing by use of a sequential multi-scan.

FIG. 15 is a view illustrating a printed data made by a sequential multi-scanning for a superposed printing.

In FIG. 15, each rectangular area surrounded by dotted lines corresponds to one dot (pixel). In case of a printing density being 400 dpi (dots/inch), for example, the area of each rectangle is approximately $(63.5\ \mu m)^2$. Those represented by small black circles are where the dots are impacted. Those where no small black circles are present are where no printing is conducted. The ink jet head is shifted in the direction indicated by an arrow F and the ink is discharged from the ink discharging nozzles in a given timing. This sequential multi-scanning is executed to correct the unevenness among each of the nozzles due to the uneven size of the ink droplets discharged from each of the nozzles and the unevenness existing in the ink discharging directions. The printing is executed by a plurality of nozzles on one and the same line (the direction in which the head is shifted). In this way, one line is formed by a plurality of nozzles and the randomicity of the nozzle characteristics of each of the ink jet heads is utilized; thus implementing the reduction of the density unevenness. In other words, if a sequential multi-scanning is executed by a two-time scanning, the printing is performed using the upper half of the ink jet head for the first scanning, and again the printing is performed using the lower half of the ink jet head for the second scanning.

Figure 16:
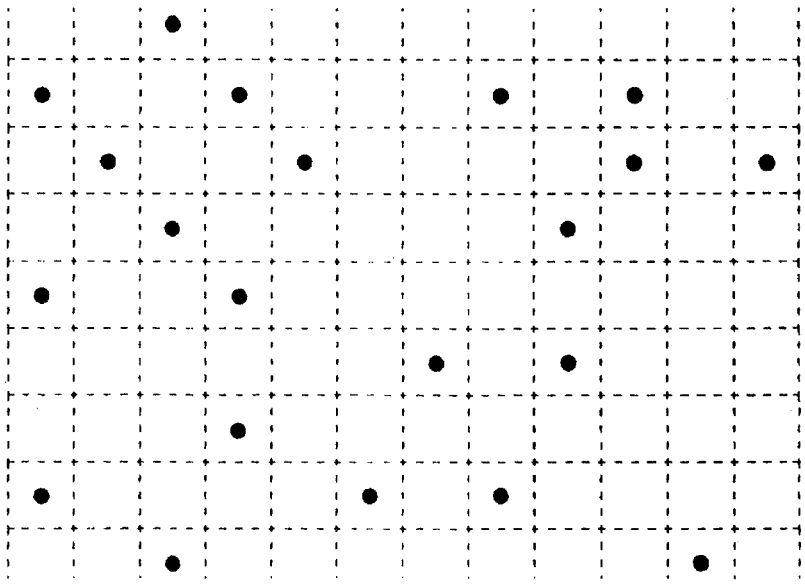
FIG. 16 is a view illustrating a printing by use of sequential multi-scan.
Figure 17:
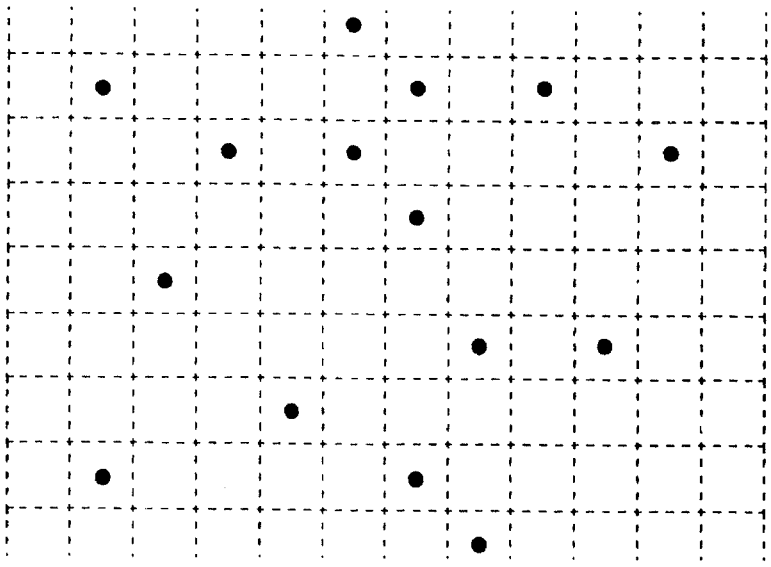
FIG. 17 is a view illustrating a printing by use of sequential multi-scan.

FIG. 16 and FIG. 17 are views showing the printed example by this sequential multi-scanning.

Now, when the data shown in FIG. 15 are printed, for example, only the printing data of odd numbers of the data created in the shifting direction of the ink jet head as shown in FIG. 16 are printed by the upper half of the ink jet head. Then, the ink jet head (carriage) is returned to in the direction of its home position, and the cloth 236 is fed in an amount equivalent to a half of the width of the ink Jet head. Then, as shown in FIG. 17, the dots of even numbers in the shifting direction of the ink Jet head are printed using the lower half of the nozzles of the ink jet head. In this way, the data shown in FIG. 15 are printed on the cloth 236 by the two-time scanning.

Figure 18:
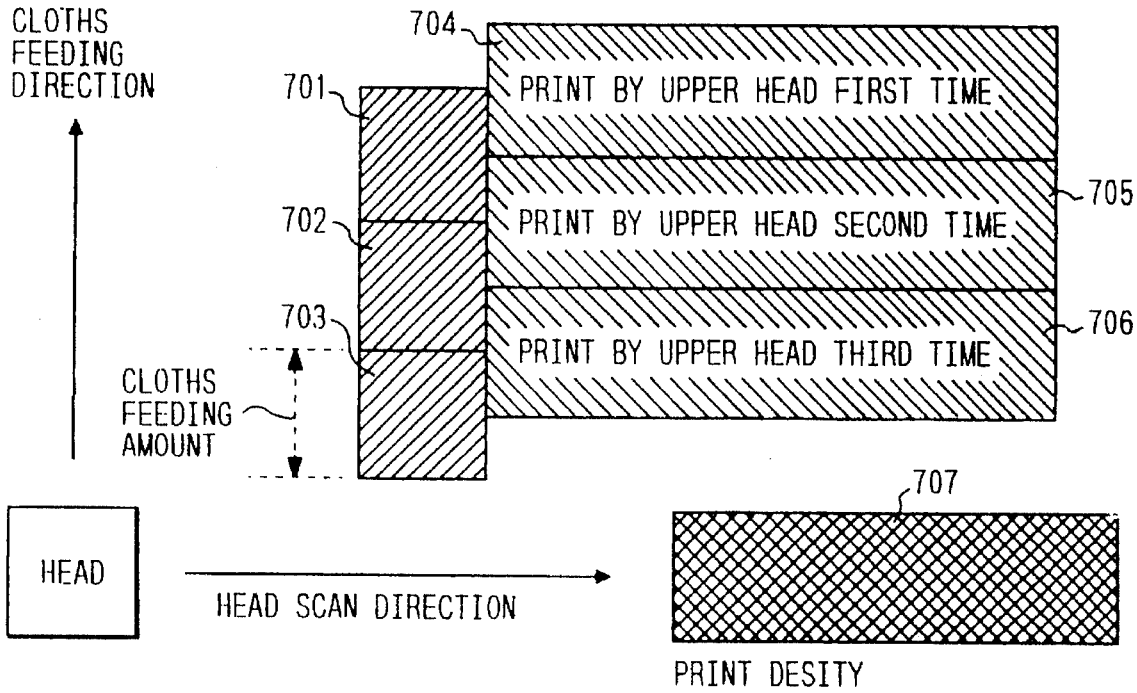
FIG. 18 is a view illustrating a printing by use of a sequential multi-scan.

FIG. 18 shows an printing example made by a usual two-time multi-scanning. The areas printed by the ink jet head of a first printing unit 231 are represented by reference marks and numerals, (down first) 701, (down second) 702, and (down third) 703, respectively; and the areas printed by the ink Jet head of a second printing unit 231', (up first) 704, (up second) 705, and (up third) 706, respectively.

The cloth feeding direction is as indicated by an arrow. The step feeding amount of the cloth 236 at a time corresponds to the printing width of the ink jet head. As clear from FIG. 18, all of the printing areas are printed by the use of either the upper half of the ink jet head of the second printing unit 231' and the lower half of the ink jet head of the first printing unit 231 or the lower half of the ink jet head of the second printing unit 231' and the upper half of the first printing unit 231. Here, the data which are printed by each of the ink Jet heads are thinned as shown in the foregoing FIG. 16 and FIG. 17, and as a result of the superposed printing by these two ink jet heads, the printing density is obtained as shown at 707.

Subsequently, the description will be made of the entire processes of the ink jet textile printing. After the ink jet textile printing process is executed by the use of the above-mentioned ink Jet printing apparatus, the textile is dried (including the natural dry). Then, in continuation, the dyestuff on textile fabric is dispersed, and a process is executed to cause the dyestuff to be reactively fixed to the fabric. With this process, it is possible for the printed textile to obtain a sufficient coloring capability and strength because of the dyestuff fixation.

For this dispersion and reactive fixation processes, the conventionally known method can be employed. A steaming method is named, for example. Here, in this case, it may be possible to give an alkali treatment to the textile in advance before the textile printing.

Then, in the post-treatment process, the removal of the non-reactive dyestuff and that of the substances used in the preparatory process are executed. Lastly, the defect correction, ironing finish, and other adjustment and finish processes are conducted to complete the textile printing.

Particularly, the following performatory characteristics are required for the textile suitable for the ink jet textile printing:

(1) Colors should come out on ink in a sufficient density.
(2) Dye fixation factor is high for ink.
(3) Ink must be dried quickly.
(4) The generation of irregular ink spread is limited.
(5) Feeding can be conducted in an excellent condition in an apparatus.

In order to satisfy these requirements, it may be possible to give a preparatory treatment to the textile used for printing as required. In this respect, the textile having an in receptacle layer is disclosed in Japanese Patent Laid-Open Application No. 62-53492, for example. Also, in Japanese Patent Publication No. 3-46589, there are proposed the textile which contains reduction preventive agents or alkaline substances. As an example of such preparatory treatment as this, it is also possible to name a process to allow the textile to contain a substance selected from an alkaline substance, water soluble polymer, synthetic polymer, water soluble metallic salt, or urea and thiourea.

As an alkaline substance, there can be named, for example, hydroxide alkali metals such as sodium hydroxide, potassium hydroxide; mono-, di-, and tori-ethanol amine, and other amines; and carbonate or hydrogen carbonate alkali metallic salt such as sodium carbonate, potassium carbonate, and sodium hydrogen carbonate. Furthermore, there are organic acid metallic salt such as calcium carbonate, barium carbonate or ammonia and ammonia compounds. Also, there can be used the sodium trichloroacetic acid and the like which become an alkaline substance by steaming and hot air treatment. For the alkaline substance which is particularly suitable for the purpose, there are the sodium carbonate and sodium hydrogen carbonate which are used for dye coloring of the reactive dyestuffs.

As a water soluble polymer, there can be named starchy substances such as corn and wheat; cellulose substances such as carboxyl methyl cellulose, methyl cellulose, hydroxy ethel cellulose; polysaccharide such as sodium alginic acid, gum arabic, locasweet bean gum, tragacanth gum, guar gum, and tamarind seed; protein substances such as gelatin and casein; and natural water soluble polymer such as tannin and lignin.

Also, as a synthetic polymer, there can be named, for example, polyvinyl alcoholic compounds, polyethylene oxide compounds, acrylic acid water soluble polymer, maleic anhydride water soluble polymer, and the like. Among them, polysaccharide polymer and cellulose polymer should be preferable.

As a water soluble metallic salt, there can be named the pH4 to 10 compounds which produce typical ionic crystals, namely, halogenoid compounds of alkaline metals or alkaline earth metals, for example. As an typical example of these compounds, NaCl, $Na_2SO_4$, KCl and $CH_3$ COONa and the like can be named for the alkaline metals, for example. Also, $CaCl_2$, $MgCl_2$, and the like can be named for the alkaline earth metals. Particularly, salt such as Na, K and Ca should be preferable.

In the preparatory process, a method is not necessarily confined in order to enable the above-mentioned substances and others to be contained in the textile. Usually, however, a dipping method, padding method, coating method, spraying method, and others can be used.

Moreover, since the printing ink used for the ink jet textile printing merely remains to adhere to the textile when printed, it is preferable to perform a subsequent reactive fixation process (dye fixation process) for the dyestuff to be fixed on the textile. A reactive fixation process such as this can be a method publicly known in the art. There can be named a steaming method, HT steaming method, and thermofixing method, for example. Also, alkaline pad steaming method, alkaline blotch steaming method, alkaline shock method, alkaline cold fixing method, and the like can be named when a textile is used without any alkaline treatment given in advance.

Further, the removal of the non-reactive dyestuff and the substances used in the preparatory process can be conducted by a rinsing method which is publicly known subsequent to the above-mentioned reactive fixation process. In this respect, it is preferable to conduct a conventional fixing treatment together when this rinsing is conducted.

In this respect, the printed textile is cut in desired sizes after the execution of the above-mentioned post process. Then, to the cut off pieces, the final process such as stitching, adhesion, and deposition is executed for the provision of the finished products. Hence, one-pieces, dresses, neckties, swimsuits, aprons, scarves, and the like, and bed covers, sofa covers, handkerchiefs, curtains, book covers, room shoes, tapestries, table clothes, and the like are obtained. The methods to machine stitch the textile to make clothes and other daily needs are disclosed widely in publicly known publications such as "Modern Knitting and Sewing Manual" published by the Textile Journal Inc. or a monthly magazine "Souen" published by Bunnka Shuppan Kyoku, and others.

As described above, according to the present invention, it is possible to obtain a high cleaning effect of the liquid discharging surface of the liquid discharging head as well as a long-time stability of the liquid discharging.

Thus, it is possible to produce the effect that the stable recovery can be executed even in a case where a highly viscous liquid is used or highly densified nozzles are employed, or further, an industrial use is required for a long time under severe conditions.

The present invention produces an excellent effect on an ink Jet printing head and printing apparatus, particularly on those employing a method for utilizing thermal energy to form flying ink droplets for the printing.

Regarding the typical structure and operational principle of such a method, it is preferable to adopt those which can be implemented using the fundamental principle disclosed in the specifications of U.S. Patent Nos. 4,723,129 and 4,740,796. This method is applicable to the so-called on-demand type printing system and a continuous type printing system. Particularly, however, it is suitable for the on-demand type because the principle is such that at least one driving signal, which provides a rapid temperature rise beyond a departure from nucleation boiling point in response to printing information, is applied to an electrothermal transducer disposed on a liquid (ink) retaining sheet or liquid passage whereby to cause the electrothermal transducer to generate thermal energy to produce film boiling on the thermoactive portion of the printing head; thus effectively leading to the resultant formation of a bubble in the printing liquid (ink) one to one for each of the driving signals. By the development and contraction of the bubble, the liquid (ink) is discharged through a discharging port to produce at least one droplet. The driving signal is preferably in the form of pulses because the 10 development and contraction of the bubble can be effectuated instantaneously, and, therefore, the liquid (ink) is discharged with quicker responses.

The driving signal in the form of pulses is preferably such as disclosed in the specifications of U.S. Pat. Nos. 4,463,359 and 4,345,262. In this respect, if the conditions disclosed in the specification of U.S. Pat. No. 4,313,124 regarding the rate of temperature increase of the heating surface is preferably are adopted, it is possible to perform an excellent printing in a better condition.

The structure of the printing head may be as shown in each of the above-mentioned specifications wherein the structure is arranged to combine the discharging ports, liquid passages, and electrothermal transducers as disclosed in the above-mentioned patents (linear type liquid passage or right angle liquid passage). Besides, it may be possible to form a structure such as disclosed in the specifications of U.S. Pat. Nos. 4,558,333 and 4,459,600 wherein the thermally activated portions are arranged in a curved area.

Furthermore, as a full line type printing head having a length corresponding to the maximum printing width, the present invention demonstrates the above-mentioned effect more efficiently with a structure arranged either by combining plural printing heads disclosed in the above-mentioned specifications or by a single printing head integrally constructed to cover such a length.

In addition, the present invention is effectively applicable to a replaceable chip type printing head which is connected electrically with the main apparatus and can be supplied with ink when it is mounted in the main assemble, or to a cartridge type printing head having an integral ink container.

Furthermore, as a printing mode for the printing apparatus, it is not only possible to arrange a monochromatic mode mainly with black, but also it may be possible to arrange an apparatus having at least one of multi-color mode with different color ink materials and/or a full-color mode using the mixture of the colors irrespective of the printing heads which are integrally formed as one unit or as a combination of plural printing heads. The present invention is extremely effective for such an apparatus as this.

Now, in the embodiments according to the present invention set forth above, while the ink has been described as liquid, it may be an ink material which is solidified below the room temperature but liquefied at the room temperature or may be liquid. Since the ink is controlled within the temperature not lower than 30° C. and not higher than 70° C. to stabilize its viscosity for the provision of the stable discharge in general, the ink may be such that it can be liquefied when the applicable printing signals are given.

In addition, while preventing the temperature rise due to the thermal energy by the positive use of such energy as an energy consumed for changing states of the ink from solid to liquid, or using the ink which will be solidified when left intact for the purpose of preventing ink evaporation, it may be possible to apply to the present invention the use of an ink having a nature of being liquefied only by the application of thermal energy such as an ink capable of being discharged as ink liquid by enabling itself to be liquefied anyway when the thermal energy is given in accordance with printing signals, an ink which will have already begun solidifying itself by the time it reaches a printing medium.

In addition, as modes of a printing apparatus according to the present invention, there are a copying apparatus combined with reader and the like, and those adopting a mode as a facsimile apparatus having transmitting and receiving functions, besides those used as an image output terminal structured integrally or individually for an information processing apparatus such as a word processor and a computer.

Figure 19:
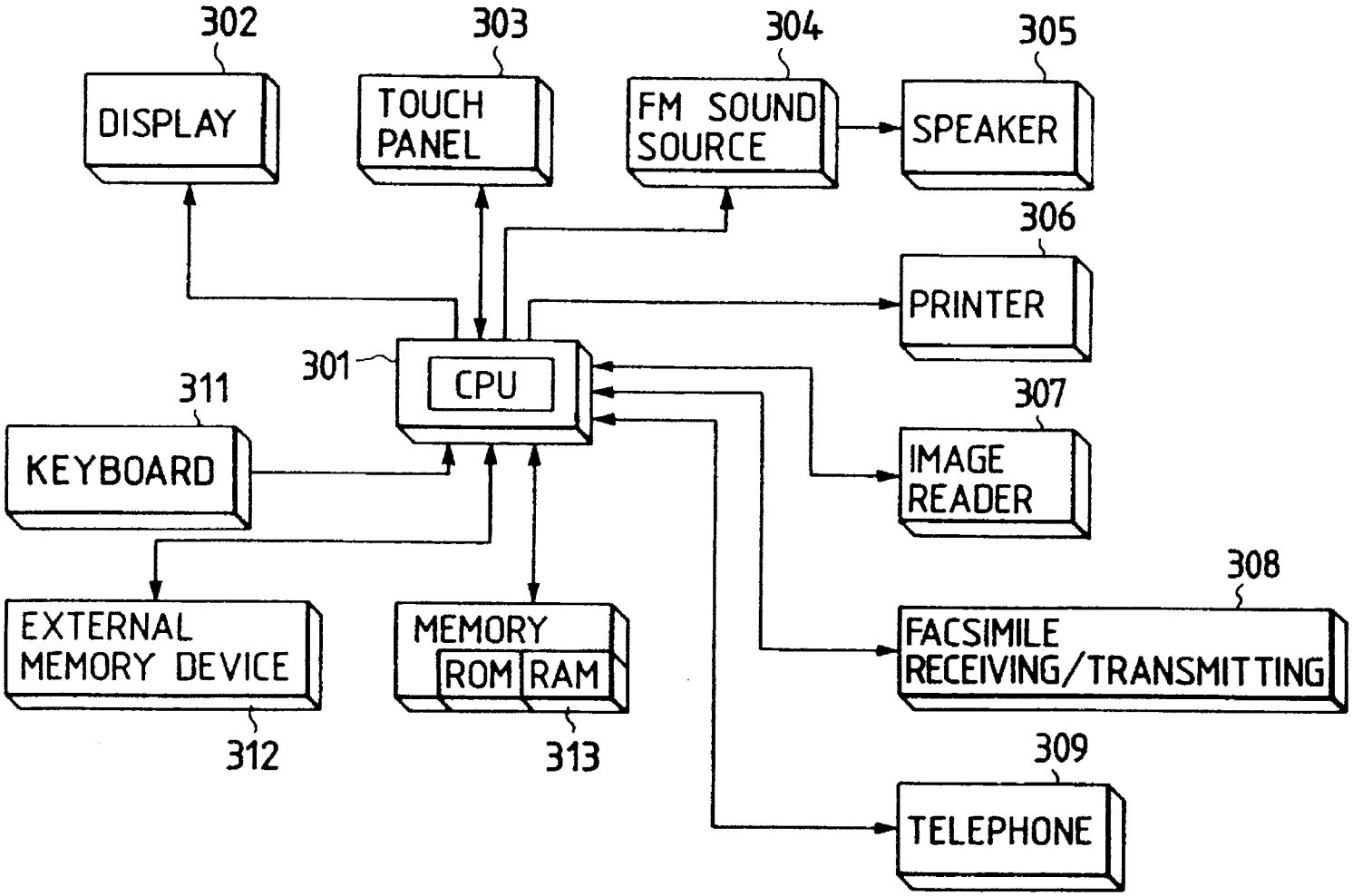
FIG. 19 is a block diagram schematically showing the structure of an information processing apparatus.

FIG. 19 is a block diagram schematically showing the structure wherein a printing apparatus according to the present invention is applied to an information processing apparatus having functions as a word 10 processor, personal computer, facsimile, and copying apparatus.

In FIG. 19, a reference numeral 301 designates a control unit to control the entire system, which is provided with a CPU comprising a microprocessor and others and various I/O ports to output control signals, data signals, and others to each unit or to receive control signals and data signals from each unit for controlling; 302, a displaying unit on the screen of which various menus, documentary information, image data and others read by an image reader 307 are displayed; and 303, a transparent pressure sensitive touch panel arranged on the display unit 302, which allows the item input and coordinate position input to be made on the display unit 302 by depressing its surface by a finger or the like.

A reference numeral 304 designates an FM (Frequency Modulation) sound generating unit wherein the musical information produced by a music editor or the like is stored in its memory 310 or in an external storage unit 312 as digital data, and then, an FM operation is executed. The electrical signals from the FM sound generating unit 304 are transduced into audible sounds through a speaker unit 305. A printing unit 306 serves as an output terminal for a word processor, personal computer, facsimile apparatus, and copying apparatus, to which a printing apparatus according to the present invention is applied.

A reference numeral 307 designates an image reading unit to photoelectrically read data on a source document for input, which is arranged on the way of the feeding passage for the source document to read a facsimile original, copying original, and other various source documents; 308, a facsimile transmitting and receiving unit whereby to transmit by facsimile the original data read by the image reading unit 307 or demodulate the facsimile signals received, and has an interface with the external units; 309, a telephone unit having various telephoning functions such as serving as an ordinary telephone or a special telephone to take messages automatically; and 310, storage unit including ROMs to store a system program, manager program, other application programs, fonts, dictionaries, and the like, RAMs to store the application program and text information loaded from an external storage unit 312, Video RAM, and others.

A reference numeral 311 designates a keyboard unit to input documentary information, various commands, and the like; 312, an external storage unit having a floppy disk and hard disk as its storing media. In this external storage unit 312, text information, music, or sound information, user's application programs are stored.

Figure 20:
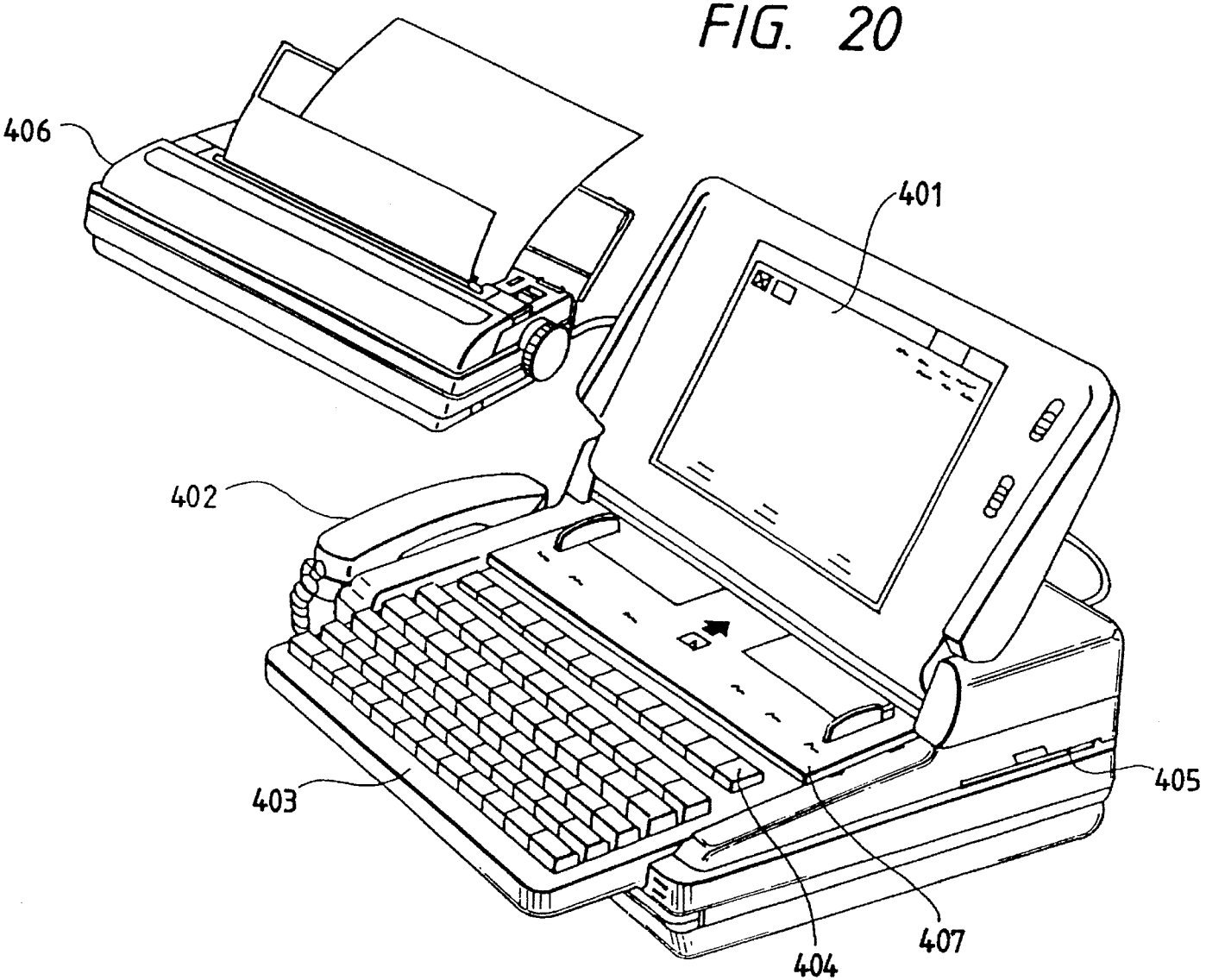
FIG. 20 is an external view showing the information processing apparatus shown in FIG. 19.

FIG. 20 is an external view of an information 10 processing apparatus shown in FIG. 19. In FIG. 20, a reference numeral 401 designates a flat panel display utilizing a liquid crystal display to display various menus, graphic information, documentary information, and the like. On the display 401, a touch panel is provided, and by depressing the surface of the touch panel by a finger or the like, it is possible to input coordinates and items specifically. A reference numeral 402 designates a hand set usable when the apparatus functions as a telephone.

The keyboard 403 is detachably connected to the apparatus through a cord to enable various text information and various data to be inputted. Also, for this keyboard 403, various functional keys 404 and the like are provided. A reference numeral 405 designates is an inlet for a floppy disk.

A reference numeral 407 designates a sheet stacking unit to stack the source documents read by the image reading unit 307, and the source documents thus read are exhausted from the rear part of the apparatus. Also, in a case of the facsimile transmission and reception, the required printing is executed by an ink jet printer 407.

In this respect, a CRT may be employed for the above-mentioned display 401, but it is preferable to use a flat panel such as a liquid crystal display utilizing a ferroelectric liquid crystal. With this, it is possible to make the apparatus small, think, and light. When the above-mentioned information processing apparatus functions as a personal computer or word processor, the various kinds of information which are inputted through the keyboard unit 311 in FIG. 20 are processed in the control unit 301 in accordance with a given program, and are output to the printing unit 306 as images. When the apparatus functions as a facsimile receiver, the facsimile information which is inputted from the facsimile transmitting and receiving unit 308 through a communication line are received and processed by the control unit 301 in accordance with a given program and is output to the printing unit 306 as the image of the signal thus received.

Figure 21:
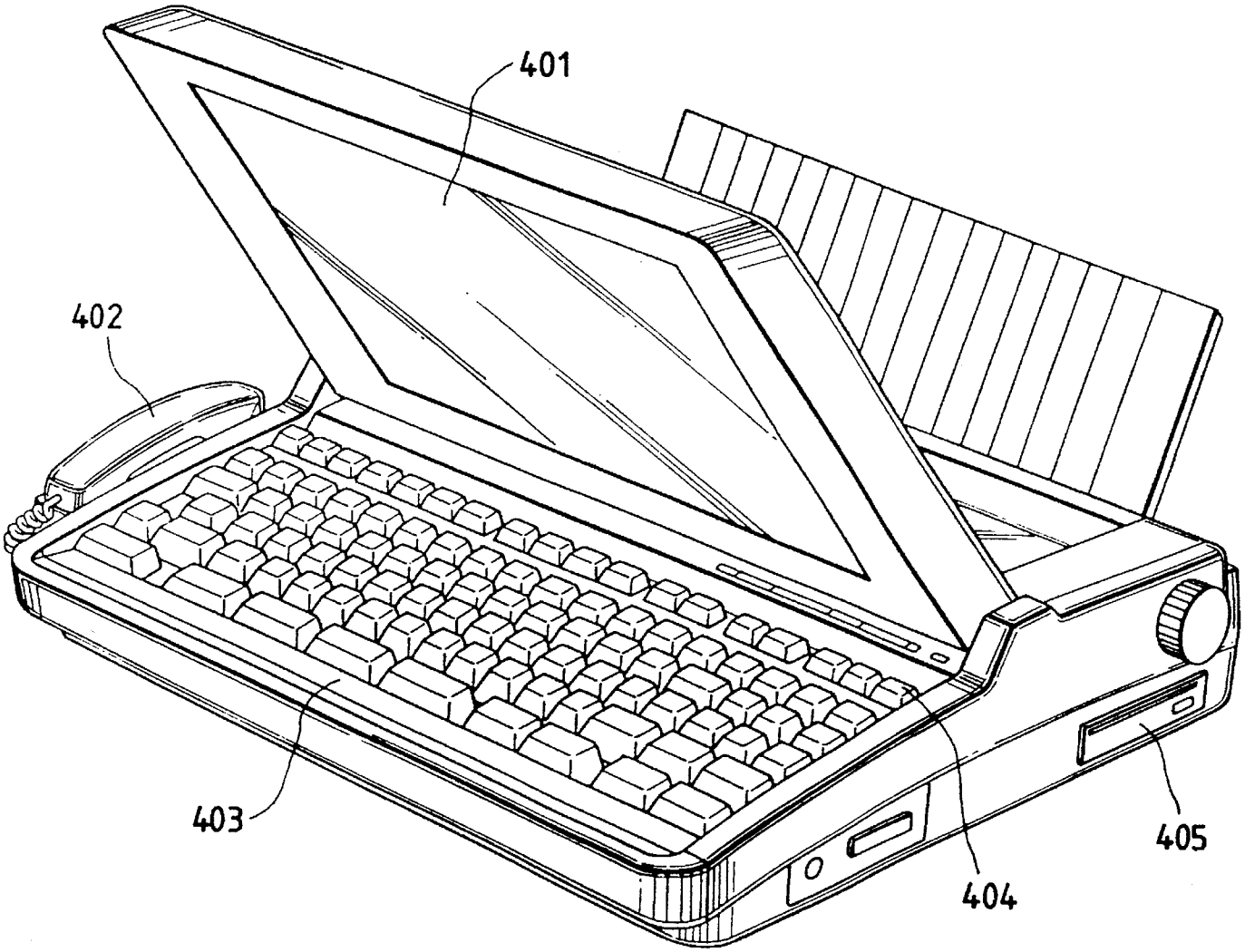
FIG. 21 is an external view showing another example of the information processing apparatus.

Also, when the apparatus functions as a copying apparatus, the source document is read by the image reading unit 307, and the data on the source document thus read are output to the printing unit 306 as the copying image through the control unit 301. In this respect, when the apparatus functions as the transmitter for the facsimile apparatus, the original data read by the image reading unit 307 are processed for transmission by the control unit 301 in accordance with a given program, and then, the data are transmitted to a communication line through the facsimile transmitting and receiving unit 308. Further, it may be possible for the above-mentioned information processing apparatus to incorporate an ink jet printer in its main body as shown in FIG. 21 as an integrated type. In this case, the portability of the apparatus can be further enhanced. In FIG. 21, the corresponding reference marks are provided for the parts having the same functions as those appearing in FIG. 20.

With the application of a liquid discharging apparatus according to the present invention to a multi-functional information processing apparatus as set forth above, it is possible to obtain a high quality print of images thereby to further enhance the functions of the above-mentioned information processing apparatus.

What is claimed is:

1. A liquid discharging apparatus for printing by using a liquid discharging head for discharging a liquid onto a printing medium, said apparatus comprising:

a cleaning member capable of containing a rinsing liquid and for cleaning the liquid discharging portion of said liquid discharging head, said cleaning member having a three-dimensional net structure;

rinsing liquid supplying means for supplying the rinsing liquid to said cleaning member to enable said cleaning member to contain the rinsing liquid;

liquid suction force generating means for generating a liquid suction force in said cleaning member while the rinsing liquid is contained in said cleaning member; and position controlling means for controlling said cleaning member to be in relative contact with the liquid discharging portion of said liquid discharging head when the liquid suction force is generated while the rinsing liquid is contained in said cleaning member, wherein said position controlling means controls the positional relation so that said cleaning member and the liquid discharging portion of said liquid discharging head butt each other correlatively to enable said cleaning member to wipe the liquid discharging portion of said liquid discharging head.

2. A liquid discharging apparatus according to claim 1, wherein said liquid discharging apparatus is used for textile printing.

3. A liquid discharging apparatus according to claim 1, wherein said cleaning member is flexible.

4. A liquid discharging apparatus according to claim 1, wherein at least a part of said cleaning member whereby to wipe said liquid discharging portion comprises a three dimensional net structure having flexibility.

5. A liquid discharging apparatus according to claim 1, wherein said rinsing liquid supplying means supplies the rinsing liquid to said cleaning member to rinse said cleaning member.

6. A liquid discharging apparatus according to claim 5, wherein said rinsing liquid supplying means discharges the rinsing liquid onto said cleaning member to rinse said cleaning member.

7. A liquid discharging apparatus according to claim 1, wherein said liquid suction force generating means has liquid absorbing means for absorbing the liquid from said cleaning member.

8. A liquid discharging apparatus according to claim 7, wherein an absorptive force of said liquid absorbing means has a force sufficient to cause the liquid to be exhausted from the liquid discharging portions of said liquid discharging head through said cleaning member when said cleaning member and the liquid discharging portion of said liquid discharging head butt each other correlatively.

9. A liquid discharging apparatus according to claim 8, further comprising:

said liquid discharging head.

10. A liquid discharging apparatus according to claim 1, wherein said liquid discharging head is capable of reciprocating with respect to a printing medium, and said cleaning member has a first wiping surface to wipe the liquid discharging portion of said liquid discharging head when said liquid discharging head is in an advancing movement, and a second wiping surface to wipe the liquid discharging portion of said liquid discharging head when said liquid discharging head is in a returning movement.

11. A liquid discharging apparatus according to claim 1, wherein a liquid absorptive force that said liquid suction force generating means creates in said cleaning member by exhausting part of the rinsing liquid in said cleaning member has a force sufficient to cause the liquid to be exhausted from the liquid discharging portion of said liquid discharging head when said cleaning member and the liquid discharging portion of said liquid discharging head butt each other correlatively.

12. A liquid discharging apparatus according to claim 1, wherein said liquid discharging head is a printing head which discharges ink by utilizing thermal energy, and is provided with the thermal energy transducers which give the thermal energy to ink.

13. A liquid discharging apparatus according to claim 12, wherein said printing head creates a state of changes in ink by the thermal energy applied by said thermal energy transducers, and discharges ink from its discharging ports in accordance with said state of changes.

14. A liquid discharging apparatus according to claim 1, further comprising:

said liquid discharging head.

15. A method for printing by using a liquid discharging head for discharging a liquid onto a printing medium, said method comprising the steps of:

providing a cleaning member capable of containing a rinsing liquid and for cleaning the liquid discharging portion of said liquid discharging head, said cleaning member having a three-dimensional net structure;

containing a rinsing liquid in said cleaning member;

generating a liquid suction force in said cleaning member while the rinsing liquid is contained in said cleaning member;

relatively contacting said cleaning member with the liquid discharging portion of said liquid discharging head when the liquid suction force is generated while the rinsing liquid is contained in said cleaning member;

controlling a positional relation of said cleaning member and the liquid discharging portion of said liquid discharging head so that said cleaning member and the liquid discharging portion of said liquid discharging head butt each other correlatively to enable said cleaning member to wipe the liquid discharging portion of said liquid discharging head; and absorbing the rinsing liquid from said cleaning member with an absorptive force sufficient to cause the liquid to be exhausted from the liquid discharging portions of said liquid discharging head through said cleaning member when said cleaning member and the liquid discharging portion of said liquid discharging head butt each other correlatively.

16. A method for printing according to claim 15, wherein said liquid discharging head is a printing head which discharges ink by utilizing thermal energy, and is provided with the thermal energy transducers which give the thermal energy to ink.

17. A method for printing according to claim 15, wherein said method is used for textile printing.

18. A method for cleaning a discharge portion of a liquid discharging head for discharging liquid on a print medium to print, said method comprising the steps of:

providing a cleaning member capable of containing a rinsing liquid and for cleaning a liquid discharge portion of said liquid discharging head, said cleaning member having a three-dimensional net structure;

containing a rinsing liquid in a cleaning member;

generating a liquid suction force in said cleaning member while the rinsing liquid is contained in said cleaning member;

relatively contacting said cleaning member with the liquid discharge portion of said liquid discharging head when the liquid suction force is generated while the rinsing liquid is contained in said cleaning member; and controlling a positional relation of said cleaning member and the liquid discharging portion of said liquid discharging head so that said cleaning member and the liquid discharging portion of said liquid discharging head butt each other correlatively to enable said cleaning member to wipe the liquid discharging portion of said liquid discharging head.

19. A method for cleaning a discharge portion of a liquid discharging head according to claim 18, wherein said liquid discharging head is a printing head which discharges ink by utilizing thermal energy, and is provided with the thermal energy transducers which give the thermal energy to ink.

20. A method for cleaning a discharge portion of a liquid discharging head for discharging liquid on a print medium to print according to claim 19, wherein said printing is textile printing.

21. An image forming apparatus for forming images by using a liquid discharging head for discharging a liquid onto a printing medium, said apparatus comprising:

a cleaning member capable of containing a rinsing liquid and for cleaning the-liquid discharging portion of said liquid discharging head, said cleaning member having a three-dimensional net structure;

rinsing liquid supplying means for supplying the rinsing liquid to said cleaning member to enable said cleaning member to contain the rinsing liquid;

liquid suction force generating means for generating a liquid suction force in said cleaning member while the rinsing liquid is contained in said cleaning member;

position controlling means for controlling said cleaning member to be in relative contact with the liquid discharging portion of said liquid discharging head when the liquid suction force is generated while the rinsing liquid is contained in said cleaning member; and means for reading original images, wherein said position controlling means controls the positional relation so that said cleaning member and the liquid discharging portion of said liquid discharging head butt each other correlatively to enable said cleaning member to wipe the liquid discharging portion of said liquid discharging head.

22. An image forming apparatus according to claim 21, wherein said liquid discharging head is a printing head which discharges ink by utilizing thermal energy, and is provided with the thermal energy transducers which give the thermal energy to ink.

23. An image forming apparatus according to claim 21, wherein said apparatus is used for textile printing.

24. An image forming apparatus for forming images by using a liquid discharging head for discharging a liquid onto a printing medium, said apparatus comprising:

a cleaning member capable of containing a rinsing liquid and for cleaning the liquid discharging portion of said liquid discharging head, said cleaning member having a three-dimensional net structure;

rinsing liquid supplying means for supplying the rinsing liquid to said cleaning member to enable said cleaning member to contain the rinsing liquid;

liquid suction force generating means for generating a liquid suction force in said cleaning member while the rinsing liquid is contained in said cleaning member;

position controlling means for controlling said cleaning member to be in relative contact with the liquid discharging portion of said liquid discharging head when the liquid suction force is generated while the rinsing liquid is contained in said cleaning member; and means for inputting printing signals, wherein said position controlling means controls the positional relation so that said cleaning member and the liquid discharging portion of said liquid discharging head butt each other correlatively to enable said cleaning member to wipe the liquid discharging portion of said liquid discharging head.

25. An image forming apparatus according to claim 24, wherein said printing signal inputting means is a keyboard.

26. An image forming apparatus according to claim 24, wherein said liquid discharging head is a printing head which discharges ink by utilizing thermal energy, and is provided with the thermal energy transducers which give the thermal energy to ink.

27. An image forming apparatus according to claim 24, wherein said apparatus is used for textile printing.

28. An information processing apparatus for forming images by using a liquid discharging head for discharging a liquid onto a printing medium, said apparatus comprising:

a cleaning member capable of containing a rinsing liquid and for cleaning the liquid discharging portion of said liquid discharging head, said cleaning member having a three-dimensional net structure;

rinsing liquid supplying means for supplying the rinsing liquid to said cleaning member to enable said cleaning member to contain the rinsing liquid;

liquid suction force generating means for generating a liquid suction force in said cleaning member while the rinsing liquid is contained in said cleaning member;

position controlling means for controlling said cleaning member to be in relative contact with the liquid discharging portion of said liquid discharging head when the liquid suction force is generated while the rinsing liquid is contained in said cleaning member; and calculation processing means, wherein said position controlling means controls the positional relation so that said cleaning member and the liquid discharging portion of said liquid discharging head butt each other correlatively to enable said cleaning member to wipe the liquid discharging portion of said liquid discharging head.

29. An information processing apparatus according to claim 24, wherein said liquid discharging head is a printing head which discharges ink by utilizing thermal energy, and is provided with the thermal energy transducers which give the thermal energy to ink.

30. An information processing apparatus according to claim 28, wherein said apparatus is used for textile printing.

31. A method for cleaning a discharge portion of a liquid discharging head for discharging liquid on a print medium to print, said method comprising the steps of:

providing a cleaning member capable of containing a rinsing liquid and for cleaning a liquid discharge portion of said liquid discharging head, said cleaning member having a three-dimensional net structure;

containing a rinsing liquid in a cleaning member;

generating a liquid suction force in said cleaning member while the rinsing liquid is contained in said cleaning member;

relatively contacting said cleaning member with the liquid discharge portion of said liquid discharging head when the liquid suction force is generated while the rinsing liquid is contained in said cleaning member; and wiping the discharge portion of said liquid discharging head by said cleaning member.

32. A printing method for printing by using a liquid discharging head for discharging a liquid onto a printing medium, comprising the steps of:

providing a cleaning member capable of containing a rinsing liquid and for cleaning a liquid discharging portion of said liquid discharging head, said cleaning member having a three-dimensional net structure;

containing a rinsing liquid in said cleaning member;

generating a liquid suction force in said cleaning member while the rinsing liquid is contained in said cleaning member;

relatively contacting said cleaning member with the liquid discharging portion of said liquid discharging head when the liquid suction force is generated while the rinsing liquid is contained in said cleaning member;

controlling a positional relation of said cleaning member and the liquid discharging portion of said liquid discharging head so that said cleaning member and the liquid discharging portion of said liquid discharging head butt each other correlatively to enable said cleaning member to wipe the liquid discharging portion of said liquid discharging head;

parting said cleaning member and the liquid discharging portion of said liquid discharging head correlatively; and printing by discharging said liquid from said liquid discharging head onto a printing medium.

33. A printing method according to claim 32, wherein said printing method implements a textile printing.

34. A printing method according to claim 32, wherein said printing medium is a textile.

35. A printing method according to claim 32, wherein said liquid discharging head is a printing head which discharges ink by utilizing thermal energy, and is provided with the thermal energy transducers which give the thermal energy to ink.

36. A printing method according to claim 35, wherein said printing head creates a state of changes in ink by the thermal energy applied by said thermal energy transducers, and discharges ink from its discharging ports in accordance with said state of changes.

37. A printing method according to claim 32, wherein said printing method is used for textile printing.

38. A liquid discharging apparatus for printing by using a liquid discharging head for discharging a liquid onto a printing medium, said apparatus comprising:

a cleaning member capable of containing a rinsing liquid and for cleaning the liquid discharging portion of said liquid discharging head, said cleaning member having a three-dimensional net structure;

rinsing liquid supplying means for supplying the rinsing liquid to said cleaning member to enable said cleaning member to contain the rinsing liquid;

liquid suction force generating means for generating a liquid suction force in said cleaning member while the rinsing liquid is contained in said cleaning member; and position controlling means for controlling said cleaning member to be in relative contact with the liquid discharging portion of said liquid discharging head when the liquid suction force is generated while the rinsing liquid is contained in said cleaning member, wherein a plurality of said liquid discharging heads are provided, and liquid discharging heads that discharge ink and liquid discharging heads that discharge a liquid other than ink are included.

39. A liquid discharging apparatus according to claim 38, wherein said liquid discharging head is a printing head which discharges ink by utilizing thermal energy, and is provided with the thermal energy transducers which give the thermal energy to ink.

40. A liquid discharging apparatus according to claim 38, wherein said liquid discharging apparatus is used for textile printing.

41. An image forming apparatus for forming images by using a liquid discharging head for discharging a liquid onto a printing medium, said apparatus comprising:

a cleaning member capable of containing a rinsing liquid and for cleaning the liquid discharging portion of said liquid discharging head, said cleaning member having a three-dimensional net structure;

rinsing liquid supplying means for supplying the rinsing liquid to said cleaning member to enable said cleaning member to contain the rinsing liquid;

liquid suction force generating means for generating a liquid suction force in said cleaning member while the rinsing liquid is contained in said cleaning member;

position controlling means for controlling said cleaning member to be in relative contact with the liquid discharging portion of said liquid discharging head when the liquid suction force is generated while the rinsing liquid is contained in said cleaning member; and means for transmitting and/or receiving image information, wherein said position controlling means controls the positional relation so that said cleaning member and the liquid discharging portion of said liquid discharging head butt each other correlatively to enable said cleaning member to wipe the liquid discharging portion of said liquid discharging head.

42. An image forming apparatus according to claim 41, further comprising:

reading means for reading original images.

43. An image forming apparatus according to claim 41, wherein said liquid discharging head is a printing head which discharges ink by utilizing thermal energy, and is provided with the thermal energy transducers which give the thermal energy to ink.

44. An image forming apparatus according to claim 41, wherein said apparatus is used for textile printing.

* * * * *

UNITED STATES PATENT AND TRADEMARK OFFICE

CERTIFICATE OF CORRECTION

PATENT NO. : 5,552,811

DATED : September 3, 1996

INVENTOR(S) : MITSURU KURATA ET AL.

It is certified that error appears in the above-identified patent and that said Letters Patent is hereby corrected as shown below:

ON THE TITLE PAGE AT [56] REFERENCES CITED
"60-053492" should read --62-053492--.
Drawings:
ON SHEET 14 IN FIGURE 18
"DESITY" should read --DENSITY--.

COLUMN 5
Line 2, "15d" should read --14d--.
Line 17, "but" should read --butt--.
Line 59, "washed" should read --washing--.

COLUMN 6
Line 24, "form" should read --from--.
Line 47, "three dimensional" should read --three-dimensional--.
Line 58, "three dimensional" should read --three-dimensional--.
Line 65, "methacrylilate," should read --methacrylate,--.
Line 66, "flouric" should read --fluoric--.

COLUMN 8
Line 33, "form" should read --from--.
Line 56, "three" should read --three---.

UNITED STATES PATENT AND TRADEMARK OFFICE

CERTIFICATE OF CORRECTION

PATENT NO. : 5,552,811

DATED : September 3, 1996

INVENTOR(S) : MITSURU KURATA ET AL.

It is certified that error appears in the above-identified patent and that said Letters Patent is hereby corrected as shown below:

COLUMN 9

Line 20, "surface" should read --surface 22.--.
Line 42, "Juncture," should read --juncture,--.

COLUMN 11

Line 17, "a" should read --an-- and "Jet" should read --jet--(both occurrences).
Line 57, "Jet " should read --jet--.

COLUMN 12

Line 30, "Jet" should read --jet--.
Line 50, "give a" should read --gives--.
Line 56, "In side" should read --Inside--.

COLUMN 13

Line 43, "randomicity" should read --randomness--.
Line 59, "Jet" should read --jet--.
Line 61, "Jet" should read --jet--.
Line 66, "an" should read --a--.

UNITED STATES PATENT AND TRADEMARK OFFICE

CERTIFICATE OF CORRECTION

PATENT NO. : 5,552,811

DATED : September 3, 1996

INVENTOR(S) : MITSURU KURATA ET AL.

It is certified that error appears in the above-identified patent and that said Letters Patent is hereby corrected as shown below:

COLUMN 14
Line 4, "Jet" should read --jet--.
Line 15, "Jet" should read --jet--.
Line 22, "Jet" should read --jet--.
Line 51, "an in" should read --a--.
Line 63, "tori-ethanol" should read --tri-ethanol--.

COLUMN 15
Line 24, "an" should read --a--.
Line 55, "cut off" should read --cut-off--.

COLUMN 16
Line 9, "Jet" should read --jet--.
Line 32, "10" should be deleted.
Line 40, "are" should be deleted.

COLUMN 17
Line 36, "10" should be deleted".

COLUMN 18
Line 17, "10" should be deleted.
Line 31, "is" should be deleted.
Line 43, "think," should read --thin,--.

UNITED STATES PATENT AND TRADEMARK OFFICE

CERTIFICATE OF CORRECTION

PATENT NO. : 5,552,811

DATED : September 3, 1996

INVENTOR(S) : MITSURU KURATA ET AL.

It is certified that error appears in the above-identified patent and that said Letters Patent is hereby corrected as shown below:

COLUMN 19
Line 48, "three" should read---three--.

COLUMN 21
Line 53, "the-liquid" should read --the liquid--.

COLUMN 23
Line 11, "claim 24," should read --claim 28,--.

Signed and Sealed this

Eleventh Day of February, 1997

Bruce Lehman

*Attest:*

BRUCE LEHMAN

*Attesting Officer*

*Commissioner of Patents and Trademarks*